US005493888A

United States Patent [19]

Merkle et al.

[11] Patent Number: 5,493,888

[45] Date of Patent: Feb. 27, 1996

[54] PRECISION FORMING APPARATUS, METHOD AND ARTICLE

[75] Inventors: Kenneth L. Merkle, Pleasant Township, Van Wert County, Ohio; Dennis J. Stuerzenberger, Monroeville, Ind.; Rick Cotterman, Convoy; Scott A. Etzler, Van Wert, both of Ohio

[73] Assignee: Aeroquip Corporation, Maumee, Ohio

[21] Appl. No.: 363,973

[22] Filed: Dec. 23, 1994

Related U.S. Application Data

[63] Continuation of Ser. No. 236,683, Apr. 29, 1994, abandoned, which is a continuation of Ser. No. 33,957, Mar. 19, 1993, abandoned, which is a continuation of Ser. No. 701,290, May 16, 1991, abandoned.

[51] Int. Cl.[6] ..... B21D 22/00; B21J 13/02

[52] U.S. Cl. ..... 72/359; 72/354.6; 72/357

[58] Field of Search ..... 72/354.6, 354.2, 72/355.6, 357, 358, 359, 360, 342.1

[56] References Cited

U.S. PATENT DOCUMENTS

| | | | |
|---|---|---|---|
| 2,633,765 | 4/1953 | Glasner | 78/23 |
| 2,748,932 | 6/1956 | Kaul | 72/358 |
| 2,810,478 | 10/1957 | Sejournet et al. | 72/358 |
| 2,836,706 | 5/1958 | Cavanagh | 219/150 |
| 2,991,552 | 7/1961 | Chatfield | 29/556 |
| 3,064,507 | 11/1962 | Strugala et al. | 78/9 |
| 3,382,692 | 5/1968 | Bodine | 72/60 |
| 3,398,444 | 8/1968 | Nemy | 29/159.2 |
| 3,712,157 | 1/1973 | Kratz et al. | 72/359 |
| 4,015,461 | 4/1977 | Schober | 72/358 |
| 4,055,975 | 11/1977 | Serfozo et al. | 72/42 |
| 4,168,619 | 9/1979 | Moore | 72/255 |
| 4,177,665 | 12/1979 | Schurmann | 72/359 |
| 4,217,771 | 8/1980 | Braun | 72/358 |
| 4,222,260 | 9/1980 | McDermott | 72/345 |
| 4,305,273 | 12/1981 | Martin | 72/359 |
| 4,321,818 | 3/1982 | Bessko | 72/453.02 |
| 4,369,077 | 1/1983 | Saito | 148/120 |
| 4,372,144 | 2/1983 | Valentine et al. | 72/352 |
| 4,416,141 | 11/1983 | Nippert | 72/345 |
| 4,426,872 | 1/1984 | Gatny | 72/359 |
| 4,466,266 | 8/1984 | Gardner et al. | 72/358 |
| 4,607,514 | 8/1986 | Nippert | 72/359 |
| 4,649,731 | 3/1987 | Eisenmann | 72/358 |
| 4,693,109 | 9/1987 | Connor et al. | 72/358 |
| 4,773,248 | 9/1988 | Yokoyama | 72/359 |

FOREIGN PATENT DOCUMENTS

| | | | |
|---|---|---|---|
| 0065235 | 12/1946 | Denmark | 72/359 |
| 0354215 | 1/1938 | Italy | 72/359 |
| 0048894 | 12/1980 | Japan | 72/360 |
| 0006751 | 1/1981 | Japan | 72/359 |
| 0192530 | 8/1988 | Japan | 72/360 |
| 0138034 | 5/1989 | Japan | 72/359 |
| 1177021 | 9/1985 | U.S.S.R. | 72/360 |
| 1250374 | 8/1986 | U.S.S.R. | 72/360 |
| 0151026 | 9/1920 | United Kingdom | 72/359 |

*Primary Examiner*—David Jones
*Attorney, Agent, or Firm*—John C. Purdue; David C. Purdue

[57] ABSTRACT

Precision forming apparatus is disclosed. The apparatus comprises a die with a cavity which conforms with the shape of a portion of a part to be formed, a punch with a cavity which conforms with the shape of another portion of the part to be formed, and means for causing relative movement of the die and the punch between (a) a first (closed) position in which the die and the punch nearly abut one another and the two cavities are aligned and form a single cavity which conforms with the shape of the part to be formed, and b) a second (open) position in which the die and the punch are separated from one another and a billet can be placed in the cavity of one to be formed, when the two are returned to the first position, to the shape of the single cavity.

The cavity forms longitudinally opposed end walls in their entirety. As a consequence, the length of a part to be formed is determined by the punch cavity, and can be changed by substituting a different punch.

23 Claims, 13 Drawing Sheets

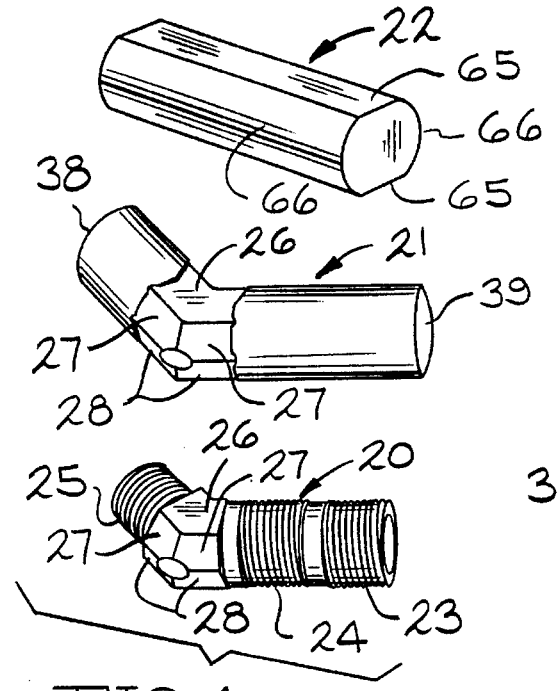
FIG. 1
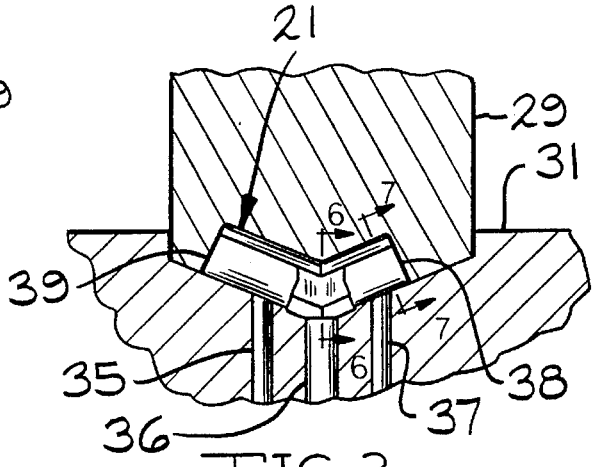
FIG. 3
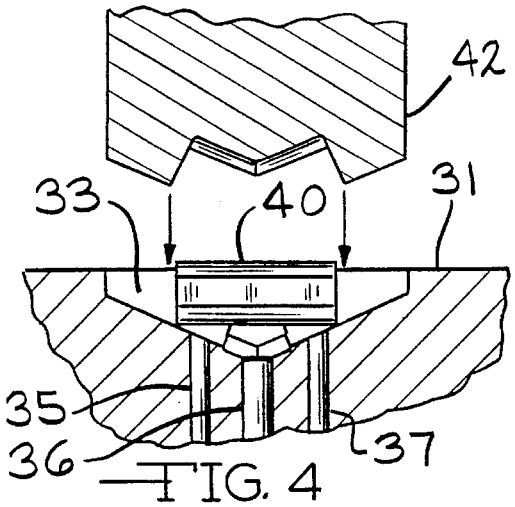
FIG. 4
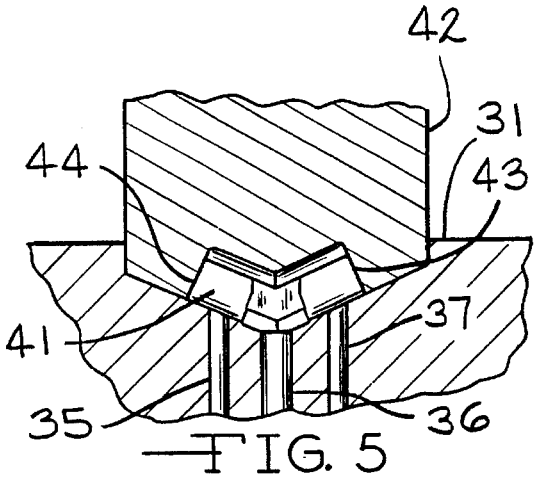
FIG. 5
FIG. 4

PRECISION FORMING APPARATUS, METHOD AND ARTICLE

REFERENCE TO RELATED APPLICATIONS

This is a continuation of application Ser. No. 08/236,683, filed Apr. 29, 1994 as a continuation of Ser. No. 08/033,957, filed Mar. 19, 1993, itself a continuation of Ser. No. 07/701,290, filed May 16, 1991. Application Ser. No. 08/236,683 is now abandoned while Ser. No. 08/033,957 and Ser. No. 07/701,290 are both abandoned.

FIELD OF THE INVENTION

This invention relates to precision forming apparatus, to methods for precision forming, and to an article and, more particularly, to such apparatus and method for producing a preformed blank from which a fitting for a hydraulic, pneumatic or the like system can be machined, to the blank, and to the fitting.

DESCRIPTION OF RELATED ART

Various precision forming methods and apparatus have previously been suggested. Such methods, which are sometimes called "precision forming processes", involve the use of matched punches and female dies which are relatively movable between open and closed positions. A blank, which may be, but is not necessarily, heated, is suitably positioned while the punch and the die are open; subsequent relative movement of the punch and die to their closed position forms the blank to the shape of the cavity formed by the two. The blank is sized carefully to contain almost exactly the amount of metal required to fill the cavity formed by the matched punch and die or to produce a part of the desired size without filling the cavity, so that there is essentially no flash on the formed article. The following U.S. patents disclose precision forming: Glasner U.S. Pat. No. 2,633,765, issued Apr. 7, 1953; Cavanagh U.S. Pat. No. 2,836,706, issued May 27, 1958; Strugala et al. U.S. Pat. No. 3,064,507, issued Nov. 20, 1962; Bodine U.S. Pat. No. 3,382,692, issued May 14, 1968; Nemy U.S. Pat. No. 3,398,444, issued Aug. 27, 1968; Schober U.S. Pat. No. 4,015,461, issued Apr. 5, 1977; Serfozo et al. U.S. Pat. No. 4,055,975, issued Nov. 1, 1977; Martin U.S. Pat. No. 4,305,273, issued Dec. 15, 1981; Bessho U.S. Pat. No. 4,321,818, issued Mar. 30, 1982; Saito U.S. Pat. No. 4,369,077, issued Jan. 18, 1983; Valentine et al. U.S. Pat. No. 4,372,144, issued Feb. 8, 1983; and Nippert U.S. Pat. No. 4,416,141, issued Nov. 22, 1983.

Nemy, supra, and U.S. Pat. No. 4,168,619, issued Sep. 25, 1979 to Moore, disclose that displacement of metal during forging processes affects the grain-orientation of the metal of the finished part.

U.S. Pat. No. 2,991,552, issued Jul. 11, 1961 to Chatfield, discloses a cold forging process where a flat, cylindrical blank with an upstanding center portion is forged in a cavity between a die and a punch. A part of the cavity is in the die; a part is in the punch. The cavity is surrounded by aligned "flash-forming land portions" of the die and punch; during cold forging, excess metal of the blank is extruded between the adjacent ends of the flash forming land portions, which are separated from one another when forging is completed.

U.S. Pat. No. 4,222,260, issued Sep. 16, 1980 to McDermott discloses apparatus for precision forming which includes an ejector rod that is supported by a ram in a lower position where its upper surface forms a part of the bottom of a die cavity and is driven by the ram to a raised position where its upper surface lifts a previously formed part above the die cavity. When the ram is withdrawn to its lower position, spring loaded detents support the ejector rod at an intermediate position between the raised and lower positions while a billet to be formed is placed on the ejector rod and until a punch drives the billet and the rod downwardly, forcing the detents to withdraw so that the rod can drop to its lower position on the ram.

BRIEF DESCRIPTION OF THE INVENTION

The present invention, in one embodiment, is based upon the discovery that precision forming can be carried out using a die and a punch, one of which has a cavity that is bounded by walls which conform with the shape of a portion of a part to be formed, including longitudinally opposed end walls in their entirety, while the other has a cavity that is bounded by walls which conform with the shape of the rest of the part to be formed, but no portion of the longitudinally opposed end walls, and that a single die or punch with a cavity which does not form any portion of the longitudinally opposed end walls can be used with a plurality of matching dies or punches, as the case may be, which differ from one another with respect to the spacing between the walls which conform with the shape of the longitudinally opposed end walls of the part to be formed to produce parts of a plurality of longitudinal lengths. A single die with a plurality of cavities and a cooperating ram which has a punch for each die cavity, when closed, can form several cavities so that a number of billets can be shaped into blanks with a single closing of the punch and the die, usually in a press, which can be mechanical, hydraulic, knuckle joint, impactor, or the like.

In another embodiment, the invention is based upon the discovery that such forming can be carried out using a die with a cavity that is bounded by walls which conform with the shape of a portion of the part to be formed, and is sufficiently deep that a billet having the weight or volume suitable to be precision formed to a desired part and a suitable shape can be placed in the cavity so that it is at least substantially completely contained therein, while the cavity in the punch is bounded by walls which conform with the shape of the rest of the part to be formed, and wherein the exterior of the punch and the interior of the die have shapes which enable the former to telescope within the latter so that, when a billet is in the die cavity and there is relative movement between the punch and the die from an open to a closed position, the billet is confined within the cavity formed by the telescoping die and punch before the closed position is reached, and the punch is capable of applying to the billet a sufficient force to cause extrusion, which force is greater than that required to cause deformation of the billet. So far as is known, the use of such dies and punches has not heretofore been suggested.

In another aspect, the invention is a formed blank from which a fitting for a hydraulic, pneumatic or the like system can be machined; the blank and the fitting have at least two longitudinally extending portions, and a microstructure in each such portion wherein substantially all of the grain is oriented parallel to the longitudinal axis of that portion.

In still another aspect, the invention is a method for producing a longitudinally extending part by precision forming using a die and a cooperating punch, one of which has a cavity with a minimum dimension of X between opposed walls which extend in the direction of punch/die relative movement, and between which a billet must pass to enter the cavity. The method comprises the steps of producing an appropriate billet having a maximum dimension in a given direction less than X, placing the billet in the die, while the punch and the die are in an open position, so that punch/die relative movement will force the part of the billet having the maximum dimension less than X between the opposed walls where the cavity has the minimum lateral dimension of X, and causing relative movement between the punch and the die to a closed position.

In still another embodiment the invention is apparatus for precision forming. The apparatus comprises a punch with a cavity which conforms with the shape of a portion of a part to be formed, a die which has a cavity, a first part of which conforms with the shape of another portion of the part to be formed, and a second part of which diverges away from the first part, and means for causing relative movement of the die and the punch between a closed position in which the punch extends through the second part of the cavity of the die, the die and the punch nearly abut one another, i.e., are separated from a closed position by a few thousandths of an inch, and the first part of the cavity of the die and the cavity of the punch are aligned and form a single cavity which conforms, at the temperature of formation, with the shape of the part to be formed, and an open position in which the die and the punch are separated from one another, the second cavity of the die is between the first cavity of the die and the cavity of the punch, and a billet can be placed in the second cavity of the die to be precision formed, when the two are returned to the closed position, to the shape of the single cavity. The apparatus also includes plates on opposite sides of the cavity of the punch, mounted for sliding movement relative to the punch in a direction parallel to the direction of relative movement between the die and the punch, and means urging the plates toward the die. The plates are so positioned that, during relative movement between the die and the punch, surfaces thereof bear upon the walls which form the second cavity of the die, and confine metal that would otherwise be scarfed from a billet.

In yet another aspect the invention is apparatus for precision forming which comprises a punch and a cooperating die composed of a plurality of die parts. The die parts are supported for limited movement relative to one another between a first open position and a second closed position. Each of the die parts has walls which surround a partial die cavity in that part. The punch and the cooperating die are mounted for limited movement relative to one another between an open punch/die position and a closed punch/die position. When the punch and the die are in a closed punch/die position, and the die parts are in the second closed position, at least one wall of the punch and the walls of the die parts which surround the partial die cavities in the die parts, enclose a cavity which has the shape required for precision forming of a desired part. When the die parts are in the first open position, the walls of the die parts which surround the partial die cavities in the die parts form a partially closed cavity into which a billet can be placed and collapsed laterally by relative movement of the die parts to the second closed position before relative movement between the punch and the die to the closed punch/die position.

The invention, in still another aspect, is apparatus for precision forming which includes a die having a cavity which conforms with the shape of a portion of a part to be formed, and a punch with a cavity which conforms with the shape of another portion of the part to be formed. The punch and the die are mounted for limited movement relative to one another between an open punch/die position and a closed punch/die position. The punch and the die nearly abut one another when in the closed position, and form a single cavity which conforms, at the temperature of formation, with the shape of the part to be formed; when in the open position, the die and the punch are separated from one another, and a billet can be placed adjacent the cavity of the die to be precision formed, when the two are returned to the closed position, to the shape of the single cavity. The apparatus also has an ejector pin which is movable relative to the die between a first position where a given surface of the pin adjoins a portion of the cavity of the die and a second position where the given surface extends into the cavity of the die, and an embossed or depressed indicium on the given surface so that a reversal of the indicium appears on a part precision formed in the apparatus.

The invention, in yet another aspect, is apparatus for precision forming which includes a die with a cavity extending therethrough, the walls which surround the cavity conforming with the shape of a portion of a part to be formed, a punch having a surface which conforms with the shape of another portion of the part to be formed, and an anvil having a surface which conforms with the shape of the rest of the part to be formed. The punch and the die are mounted for movement relative to one another and the anvil and the die are mounted for movement relative to one another. In a closed position, a part of the punch, a part of the die and a part of the anvil form a single closed cavity which has the shape of a part to be precision formed in the apparatus. In an open position, a billet can be positioned so that it will be precision formed during relative movement to the closed position. The die and the anvil can also be mounted for movement relative to one another for the purpose of ejection a precision formed part from the cavity of the die.

In still another aspect the invention is apparatus for precision forming which includes a die having several cavities, each of which has a part which conforms with the shape of a portion of a part to be formed, and a plurality of punches, each of which has a cavity which conforms with the shape of another portion of a part to be formed in one of the die cavities. The die and the punches are mounted for simultaneous relative movement between an open position and a closed position. In the closed position, each of the punches nearly abuts one of the die cavities and forms therewith a single cavity which conforms, at the temperature of formation, with the shape of a part to be formed, while, in the open position, the die and each of the punches are separated from one another, and a billet can be positioned to be precision formed in each of the cavities when the die and the punches are returned to the closed position, to the shape of the single cavity.

In yet another aspect, the invention is apparatus for precision forming a shape which includes a central body and opposed legs extending in a given direction from the central body. The apparatus has a die with a cavity which conforms with the shape of a portion of the part to be formed, and a cooperating punch with a cavity which conforms with the shape of another portion of the part to be formed. The punch and the die are mounted for relative movement in the given direction between a closed position and an open position. In the closed position the punch and the die nearly abut one another, and the cavity of the die and the cavity of the punch are aligned and form a single cavity which conforms, at the temperature of formation, with all of the shape of the part to be formed except the ends of the legs. In the open position the die and the punch are separated from one another, and a billet can be positioned to be precision formed by the punch and the die when the two are returned to the closed position, to the shape of the single cavity. There are also plates on opposite sides of the cavity of the punch, mounted for sliding movement relative to the punch in a direction parallel to the direction of relative movement between the die and the punch, and resiliently urged toward the die. The plates are so positioned that, during relative movement between the die and the punch, end surfaces thereof contact and shape the ends of the legs of the part being precision formed.

BRIEF DESCRIPTION OF THE DRAWINGS

FIG. 1 is a perspective view showing a threaded, high pressure fitting, a precision formed blank from which the fitting can be produced by machining, and a billet from which the blank can be produced by precision forming.

FIG. 3 is a vertical sectional view showing the die and the punch of the press of FIG. 2 in a closed position.

FIG. 4 is a view in vertical section showing the die of FIGS. 2 and 3 and a punch in an open position, with a billet in position to be precision formed; the punch, which is different from that of FIG. 3, produces a different part in the same die.

FIG. 5 is a vertical sectional view showing the punch and die of FIG. 4 in a closed position, and a formed blank in the die cavity.

DESCRIPTION OF THE PREFERRED EMBODIMENTS

Figure 2:
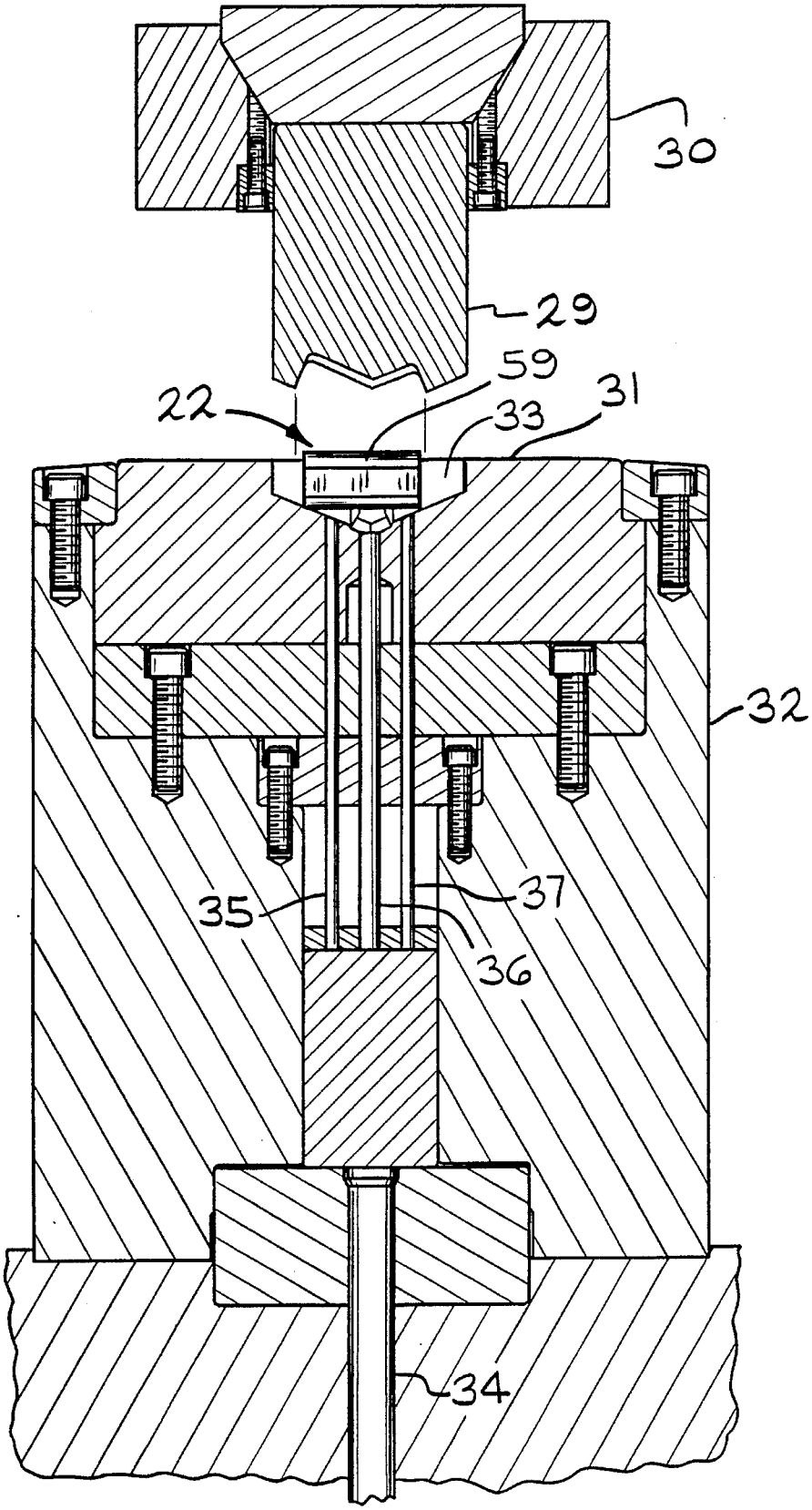
FIG. 2 is a view in vertical section showing a portion of a press, including a die and a punch in an open position, in which precision forming according to the invention can be carried out to produce the blank of FIG. 1.

Referring now in more detail to the drawings and, in particular, to FIG. 1, a 45° fitting for a hydraulic, pneumatic or the like system is indicated generally at 20, a precision formed blank according to the invention is indicated generally at 21, and a billet is indicated generally at 22. The blank 21 can be precision formed as subsequently described herein from the billet 22. The specific fitting 20 has three threaded portions, designated 23, 24 and 25, and central flats, three of which, designated 26, 27 and 28, are seen in FIG. 1. A fourth flat, not shown in FIG. 1, is parallel to the flat 26, so that the two can be gripped by a wrench having parallel jaws. The blank 21 is machined to form the three threaded portions 23, 24 and 25 of the fitting 20, but the flats 26, 27, 28 and the flat not shown in FIG. 1 are produced by the precision forming step, so that they appear in the blank 21. Fittings that can be produced from precision formed blanks can also be, by way of example, 90° fittings, "Y" shaped fittings, "T" shaped fittings, "Cross" shaped fittings, and the like. The 90°, "Y" shaped, "T" shaped, "Cross" shaped, and the like fittings that can be produced from precision formed blanks according to the invention can have bodies with flats that can be gripped by a wrench, as shown in FIG. 1, or they can have round body styles as shown in some of the drawings hereof, and subsequently described in connection therewith; the fittings are used in earth moving and other mobile equipment, in machine tools, and in aerospace applications. They are made from materials such as carbon steels, brass, stainless steels, monel, inconel and titanium alloys.

A press shown fragmentarily in FIG. 2 comprises a punch 29 mounted for movement with a ram 30 relative to a die 31 which is mounted in a stationary bed 32. A billet 22, which is usually a carbon steel, brass, stainless steel, monel, inconel or titanium billet, heated to a suitable temperature, e.g., about 1400° F. (760° C.) in the case of a steel billet, and having a carefully controlled weight or volume, is shown in a cavity 33 of the die 31. To produce the precision formed blank 21, the ram 30 is lowered from the open press position shown in FIG. 2 until the punch 29 reaches the closed position shown in FIG. 3 relative to the die 31. The ram 30 is then raised again to reopen the press, and a ram 34 is raised from the position shown in FIG. 2 to raise ejector pins 35, 36 and 37 and to force the blank 21 out of the cavity 33. The shape of the cavity, when the press is closed, formed partly by the walls of the die and partly by the walls of the punch, is the same, except for shrinkage, as the shape of the blank 21. It will be appreciated that the portion of the cavity that is bounded by walls of the punch 29 forms a part of the blank 21, including longitudinally opposed end walls 38 and 39 (FIGS. 1 and 3) in their entirety, while the portion of the cavity that is bounded by walls of the die 31 forms the rest of the blank 21, but no portion of the longitudinally opposed end walls 38 and 39.

It will be noted that the upper end of the ejector pin 36 forms a part of the wall of the cavity in which blanks 21 are precision formed. It has been found to be desirable to shape this end so that it produces a logo, e.g., a trademark, part designation or both, on the blanks 21. Since this part of the blank is not machined to produce the fitting 20, the logo remains on the fitting.

The weight or volume of the billet 22 used in the apparatus of FIGS. 2 and 3 is carefully controlled to be substantially 2 percent less than the weight or volume of a billet which would exactly fill the cavity formed by walls of the punch 29 and by walls of the die 31. There is, of course, some variation in the weight and volume of billets cut from time to time. It is imperative that the billet 22 not contain so much metal that the punch 29 is unable to move to the fully closed position relative to the die 31, as this would "crash" the apparatus by breaking the weakest part thereof. It is also important that the weight or volume of the billet 22 be sufficiently great that the fitting 20 can be machined from the blank 21, i.e., that the blank 21 is not smaller than the cavity formed partly by the walls of the die 31 and partly by the walls of the punch 29 by an amount great enough that it does not contain sufficient metal to be machined to the configuration of the fitting 20. It has been found to be practical to size the cavity so that billets 22 having a nominal weight or volume 2 percent less than that required to fill the cavity consistently produce precision formed blanks 21 from which fittings 20 can be machined.

It will be appreciated that that the present invention is concerned with the previously discussed relationships between the punch 29 and the die 31 in the apparatus of FIGS. 2 and 3, and that the details of the press in which they are shown are merely one example of an environment in which the punch 29 and the die 31 can be used. Various possible modifications of the press will be apparent to one skilled in the art, and can be used in practicing the invention of FIGS. 2 and 3 and others of the instant invention as subsequently described herein. It will also be appreciated that, while the punch 29 and the die 31 (and other punch and die combinations that are shown in the attached drawings and subsequently described herein) undergo relative movement between an "open" and a "closed" position, it is necessary that there be enough clearance between the two when in the "closed" position that the apparatus is not subjected to excessive stresses.

Referring to FIG. 4, a billet 40 heated to a suitable temperature, and weighing substantially 2 percent less than a billet which would fill the cavity in which a precision formed blank 41 (FIG. 5) is formed therefrom, is shown in the cavity 33 of the die 31. To produce the blank 41, a punch 42 is lowered from the open press position shown in FIG. 4 until the punch 42 reaches the closed position shown in FIG. 5 relative to the die 31. The punch 42 is then raised again to the open press position, and the ejector rods 35, 36 and 37 are raised to force the blank 41 out of the cavity 33. The shape of the cavity, when the press is closed, formed partly by the walls of the die and partly by the walls of the punch, is the same, except for shrinkage, as the shape of the blank 41, but is different from the shape of the cavity formed by the punch 29 and the die 31, as shown in FIGS. 2, 3, 6 and 7. It will be appreciated that the die 31 is used with the punch 29 in the apparatus of FIGS. 2, 3, 6 and 7 to produce one precision formed blank and with the punch 42 in the apparatus of FIGS. 4 and 5 to produce a different precision formed blank, and that this is possible because the portion of the die cavity that is bounded by walls of the punch includes longitudinally opposed ones which form opposed end walls (43 and 44 in FIGS. 4 and 5 and 38 and 39 in FIGS. 2 and 3) in their entirety, while the portion of the cavity that is bounded by walls of the die 31 forms the shape of the rest of the part, but no portion of the longitudinally opposed end walls.

Figure 8:
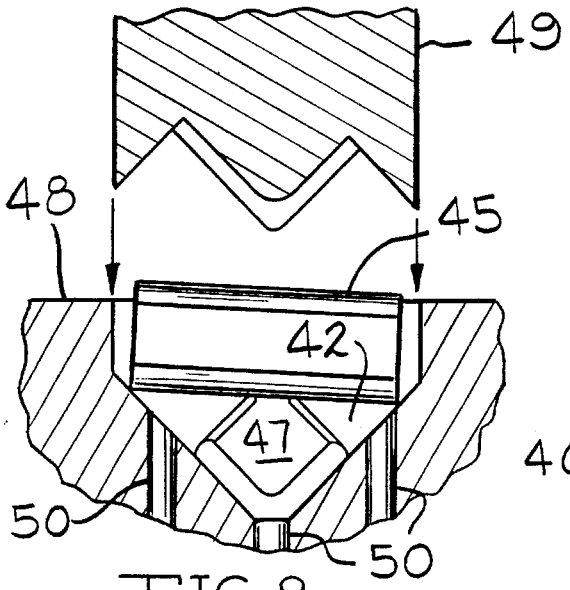
FIG. 8 is a view in vertical section, similar to FIG. 4, but showing a different punch and die combination in an open position, with a billet in position to be precision formed.

Referring to FIG. 8, a steel billet 45 heated to a suitable temperature, and weighing substantially 2 percent less than a billet which would fill the cavity in which a blank 46 (FIG. 9) is formed therefrom, is shown in a cavity 47 of a die 48. To produce the blank 46, a punch 49 is lowered from the open press position shown in FIG. 8 until the punch 49 reaches the closed position relative to the die 48 shown in FIG. 9. The punch 49 is then raised again to the open press position, and ejector rods 50 are raised to force the blank 46 out of the cavity 47. The shape of the cavity, when the press is closed, formed partly by the walls of the die and partly by the walls of the punch, is the same, except for shrinkage, as the shape of the blank 445. It will be appreciated that, as in the apparatus of FIGS. 2 and 3 and in that of FIGS. 4 and 5, the portion of the cavity that is bounded by walls of the punch (49 in FIGS. 8 and 9) forms a part of the blank 445, including longitudinally opposed end walls 51 and 52 (FIG. 9) in their entirety, while the portion of the cavity that is bounded by walls of the die 48 forms the rest of the blank 46, but no portion of the longitudinally opposed end wails. It will also be appreciated that numerous different precision formed blanks can be made with the dies 31 (FIGS. 2–7) and 48 (FIGS. 8–11) and different cooperating punches having analogous cavity portions which form longitudinally opposed end walls and, generally, that a plurality of punches which form the longitudinally opposed end walls can be used with a single cooperating die to produce numerous different precision formed blanks.

Figure 12:
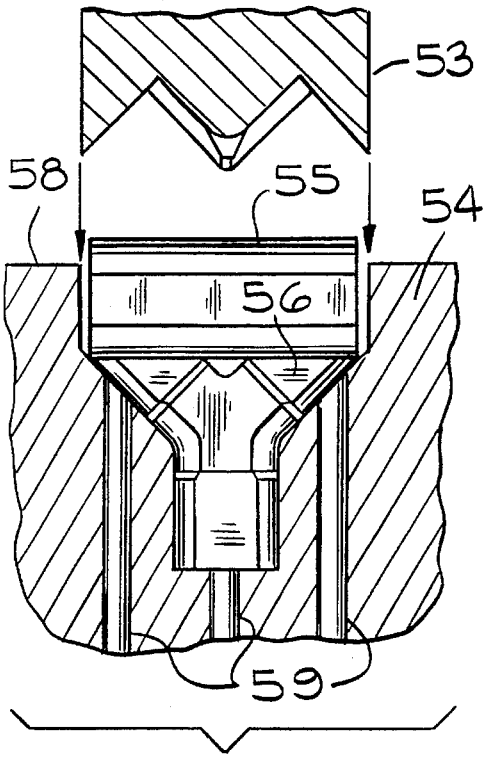
FIG. 12 is a view in vertical section, similar to FIGS. 4 and 8, but showing a punch and die combination, in an open position, with a billet in position to be precision formed into a blank from which a "Y" shaped fitting can be produced.
Figure 13:
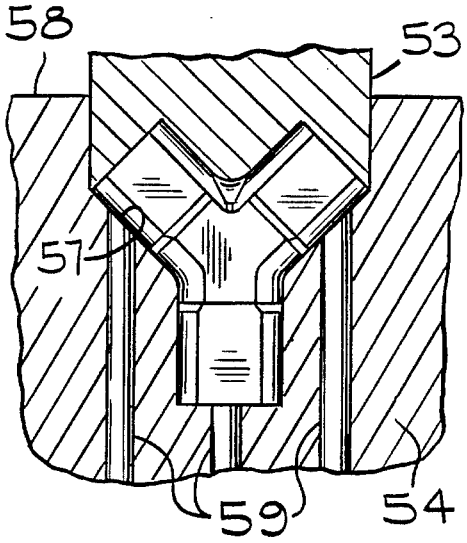
FIG. 13 is a vertical sectional view showing the punch and die combination of FIG. 12 in a closed position and a formed, "Y" shaped blank in the die cavity.

A punch 53 and a cooperating die 54 are shown in FIG. 12 in an open position with a billet 55 in a cavity 56 of the die 54 and in FIG. 13 in a closed position with a "Y" shaped precision formed blank 57 filling the cavity of the die 54. The top of the billet 55 extends slightly above a surface 58 of the die 54 when the press is in the open position shown in FIG. 12. When the punch 53 is lowered from the position shown in FIG. 12, it first deforms the billet slightly and then, with further advancement, its sidewalls telescope within the cavity, forming a relatively tight seal with the walls of the die 54 which surround the cavity 56, and causing further deformation and extrusion thereof into the bottom leg of the "Y" in the die 54, until the blank 57 is formed. The apparatus includes ejector rods 59 to force the finished blank from the cavity 56, usually as the punch 53 is being withdrawn to its open position.

Figure 14:
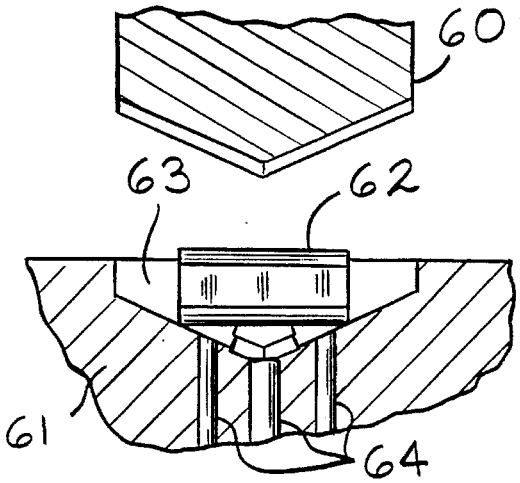
FIG. 14 is a view in vertical section similar to FIG. 4, but showing a different cooperating punch.

A punch 60 and a cooperating die 61 are shown in FIG. 14 in an open position with a billet 62 in a cavity 63 of the die 61. The punch 60 is similar to that designated 29 (FIGS. 2 and 3), differing in that it does not have wings to form the longitudinally opposed end walls 38 and 39 (FIG. 3). As a consequence, when the punch 60 (FIG. 14) is moved from the open position shown to a closed position relative to the die 61, the billet 62 is deformed and extruded longitudinally. The deformation and extrusion produce one of many precision formed blanks having, in the case shown, generally the shape of the blank 21 (FIG. 1) and longitudinal lengths (between the surfaces 38 and 39, FIG. 1) which depend upon the weight or volume of the billet 62, varying as a direct function of this weight or volume. The apparatus includes ejector rods 64 to urge a precision formed blank from the cavity 63 as the punch 60 is moved upwardly from the die 61 to the position shown in FIG. 14. The longitudinally opposed ends of the blank produced in the apparatus of FIG. 14 are not true, but this is acceptable because the desired hydraulic fitting can be produced by machining so long as the cavity is filled in precision forming of the blank to such an extent that it is necessary only to remove metal. It is sometimes economically advantageous to remove a comparatively small amount of extra metal by machining in order to avoid the necessity for producing a plurality of punches.

The billet 22 (FIG. 1) has opposed flat surfaces 65,65 and arcuate ends 66,66. This is a preferred shape for the billets 22, 40, 48 and 55 for use in producing precision formed blanks in the apparatus of FIGS. 2, 8, 4 and 12, respectively. The cross-sectional shape can be formed by extrusion, and a billet of the desired weight or volume, as discussed above, can be cut from the extruded stock. It has been found to be important, referring to FIGS. 2 and 3

(1) that the billet 22 be placed in the die 31 so that the opposed flat surfaces 65,65 are parallel to the direction of movement (which is vertical in the apparatus of FIGS. 2 and 3) of the punch 29 relative to the die 31 between the open and closed positions;

(2) that the cavity 33 in the die 31 be oriented so that it has a given minimum dimension in a plane at right angles to the direction of movement of the punch 29 relative to the die 31; and (3) that the vertical distance between the opposed flat surfaces 65,65 of the billet 22 be slightly less than the given minimum dimension of the cavity 33.

Figure 6:
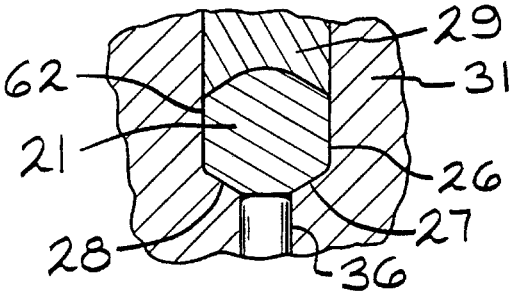
FIG. 6 is a view in vertical section taken along the line 6—6 of FIG. 3.
Figure 7:
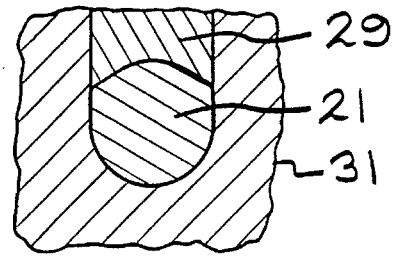
FIG. 7 is a vertical sectional view taken along the line 7—7 of FIG. 3.

As has been stated above, when the punch 29 and the die 31 are in the closed position, they form a cavity having the shape, disregarding shrinkage, of the blank 21. In that cavity, the minimum dimension in a horizontal plane, more generally, in a plane at right angles to the direction of movement of the punch 29 relative to the die 31, is between the flat 26 (FIG. 1) and an opposed, parallel flat 67 (FIG. 6). The thickness of the billet 22, between the flat surfaces 65,65, is slightly less than this minimum dimension. It has been found that a billet having a volume substantially 2 percent less than that which would fill the cavity formed by the punch 29 and the die 31, and identical to the billet 22, except that the thickness (between the flat surfaces 65,65) is greater than the minimum dimension, is unsatisfactory for precision forming in the apparatus of FIGS. 2 and 3 to produce the blank 21 because, as the punch 29 moves from the open position shown in FIG. 2 to the closed position shown in FIG. 3, metal is scarfed from the flat surfaces which correspond with those designated 65,65 and, as a consequence, does not become a part of the formed blank. Apparatus having a cavity with a given lateral dimension in which billets having a lateral dimension greater than the given dimension can be precision formed is shown in FIGS. 15, 16 and 24 through 27, and discussed in connection therewith.

Figure 15:
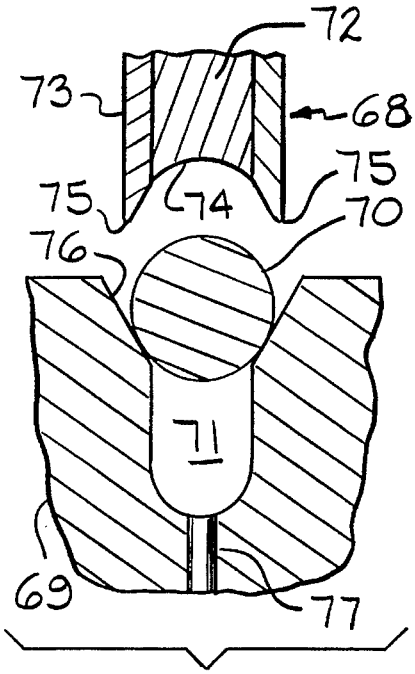
FIG. 15 is a vertical sectional view showing a modified die and punch combination which is capable of precision forming a blank from a billet that has a lateral dimension, from left to right in FIG. 15, greater than the corresponding dimension of the die.

A composite punch indicated generally at 68 and a die 69 are shown in FIG. 15 in an open position with a billet 70 in a cavity 71 of the die 69. The composite punch has a central forming portion 72 and outer plates 73 which are mounted for sliding upward movement relative to the portion 72 from the position shown, and are spring loaded against stops (not illustrated) to the position shown. The billet 70 is circular in cross-section and has a diameter greater than the lateral width (left to right) of the lower portion of the cavity 71 into which it must be forced to produce a precision formed blank. When the composite punch 68 is moved downwardly from the position shown, a surface 74 (arcuate in section) of the forming portion 72 makes contact with the billet 70 at about the same time that tips 75 of the plates 73 make contact with a surface 76 of the die 69 which tapers downwardly and inwardly to the cavity 71. As the forming portion 72 moves farther down toward the closed position the billet 70 is confined between inner surfaces of the plates 73 so that the entire billet is forced into the cavity 71. The apparatus includes ejector rods 77 (one of which is shown in FIG. 15) to urge a precision formed blank from the cavity 71 usually as the punch 68 is being moved upwardly from the die 69 to the position shown in FIG. 15.

Figure 16:
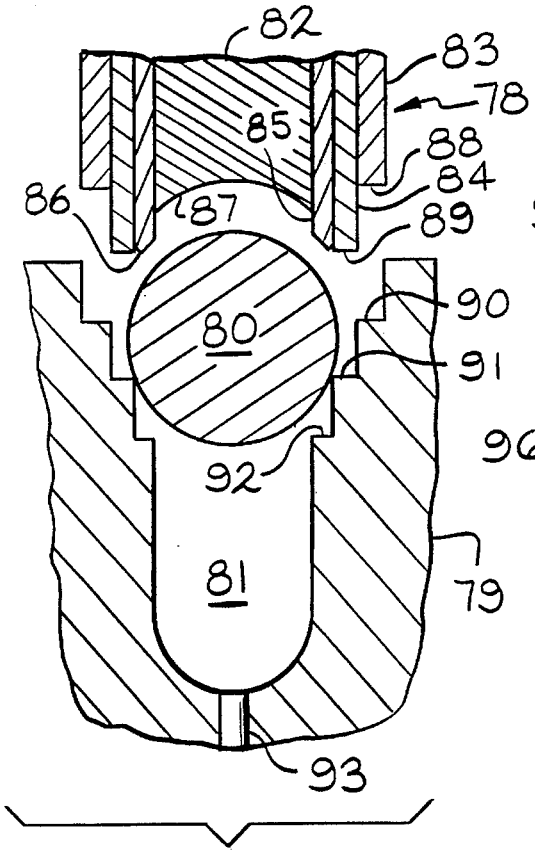
FIG. 16 is a view in vertical section showing another modified die and punch combination that is similar to the combination of FIG. 15 in that it is capable of precision forming a blank from a billet that has a lateral dimension greater than the corresponding dimension of the die.

Another composite punch indicated generally at 78 and a die 79 are shown in FIG. 16 in an open position with a billet 80 in a cavity 81 of the die 79. The composite punch has a central forming portion 82 and plates 83, 84 and 85, each of which is mounted for upward sliding movement relative to the forming portion 82, and is spring loaded against a stop (not illustrated) to the position shown. The billet 80 is circular in cross-section and has a diameter greater than the lateral width (left to right) of the lower portion of the cavity 81 into which it must be forced to produce a precision formed blank. When the composite punch 78 is moved down from the position shown, ends 86 of the plates 85 make contact with the billet 80, stopping the downward movement of the plates 85. Next, a surface 87 (arcuate in section) of the forming portion 82 makes contact with the billet 80 at about the same time that ends 88 and 89 of the plates 83 and 84 make contact with steps 90 and 91 of the die 79. As the forming portion 82 of the punch 78 moves farther down toward the closed position the plates 85 also move down, so that a part of the billet 80 is confined between the plates 84 and the rest is confined between the plates 85. Ultimately, the ends 86 of the plates 85 make contact with a step 92 of the die 79, and the forming portion 82 continues to move downwardly until it completes the precision forming step, forcing the entire billet 80 into the cavity 81. The apparatus includes ejector rods 93 (one of which is shown in FIG. 16) to urge a precision formed blank from the cavity 81, usually as the punch 78 is being moved upwardly from the die 79 to the position shown in FIG. 16.

Figure 17:
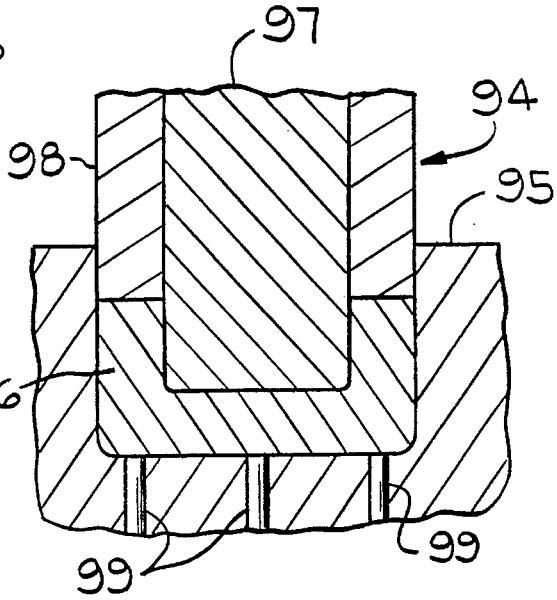
FIG. 17 is a vertical sectional view showing a punch and die combination, in a closed position, with a formed "U" shaped blank in the die cavity.

A composite punch indicated generally at 94 and a die 95 are shown in FIG. 17 in a closed position with a formed blank 96 (shown in section) in a cavity formed by the die 95 and the punch 94. The composite punch has a central forming portion 97 and outer plates 98 which are mounted for sliding movement relative to the portion 97, and spring loaded against a stop (not illustrated) to a given position. The blank 96 is formed from a suitable billet as previously described. When the composite punch 94 is moved downwardly to the position shown, a lower surface of the forming portion 97 makes contact with the billet (not illustrated) and urges it into the die 95, forcing some of the billet around the portion 97 to form the parallel legs of the blank 96. The legs bear upon the plates 98, forcing them upwardly against the spring loading to the positions shown. The apparatus includes ejector rods 99 to urge the precision formed blank 96 from the cavity in which it was formed, usually as the punch 94 is being moved upwardly from the position shown in FIG. 17 to the open press position (not illustrated). The blank 96 is generally "U" shaped, having such a configuration that it can be cut transversely of the bottom leg of the "U" to produce two blanks from which 90° fittings can be machined. Each of the two blanks could have generally the shape of the blank 46 of FIG. 9, or any other desired shape.

Figure 18:
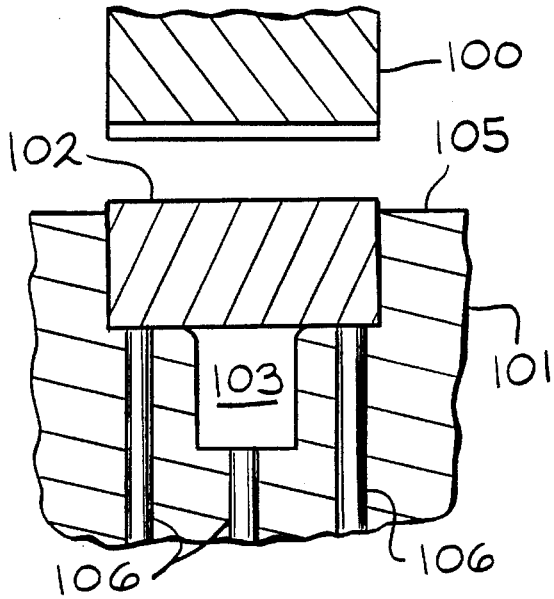
FIG. 18 is a view in vertical section, similar to FIGS. 4, 8 and 12, but showing a punch and die combination, in an open position, with a billet in position to be precision formed to produce a blank from which a "T" shaped fitting can be produced.
Figure 19:
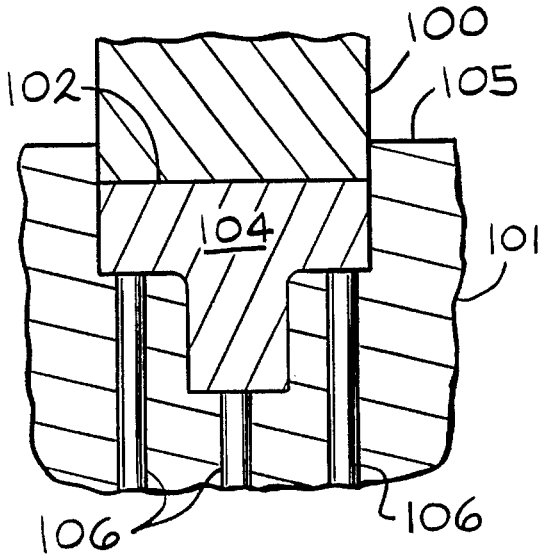
FIG. 19 is a vertical sectional view showing the punch and die combination of FIG. 18 in a closed position and a formed, "T" shaped blank in the die cavity.

A punch 100 and a cooperating die 101 are shown in FIG. 18 in an open position with a billet 102 (shown in section) in a cavity 103 of the die 101 and in FIG. 19 in a closed position with a "T" shaped precision formed blank 104 (also shown in section) filling the cavity of the die 101. The top of the billet 102 extends slightly above a surface 105 of the die 101 when the press is in the open position shown in FIG. 18. The punch 100, when it is lowered from the position shown in FIG. 18, first deforms the billet slightly and then, with further advancement, its sidewalls telescope within the cavity, forming a relatively tight seal with the walls of the die 101 which surround the cavity 103, causing further deformation thereof and extrusion of the deformed billet into the bottom leg of the "T" in the die 101 until the blank 104 is formed. The apparatus includes ejector rods 106 to force the finished blank from the cavity 103, usually as the punch 100 is being withdrawn to its open position. The billet 102 can have any desired external shape which is compatible with precision forming, and the precision formed T-shaped blank 104 can have any desired exterior configuration.

Figure 20:
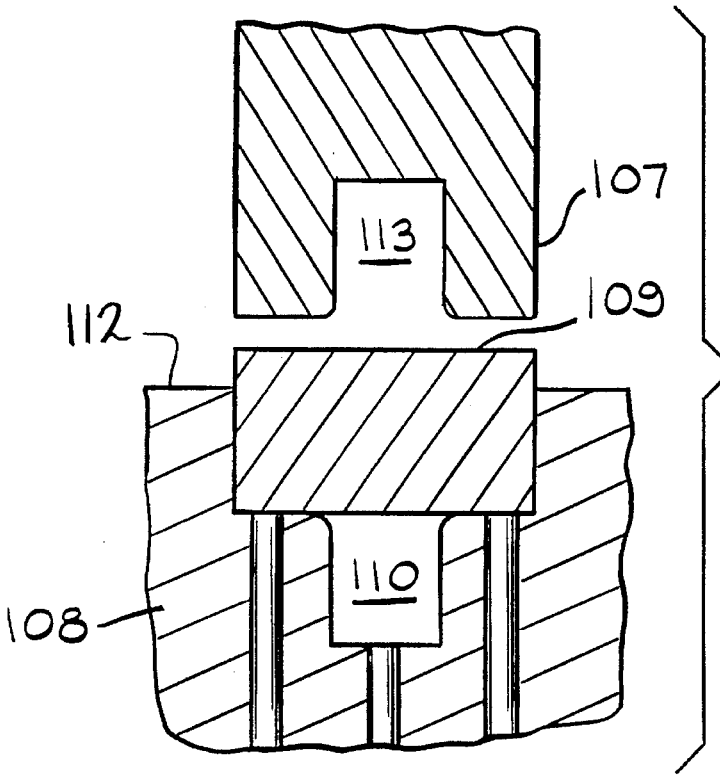
FIG. 20 is a view in vertical section, similar to FIGS. 4, 8, 12 and 18, but showing a punch and die combination, in an open position, with a billet in position to be precision formed into a blank from which a fitting can be produced which has the shape of a "Cross".
Figure 21:
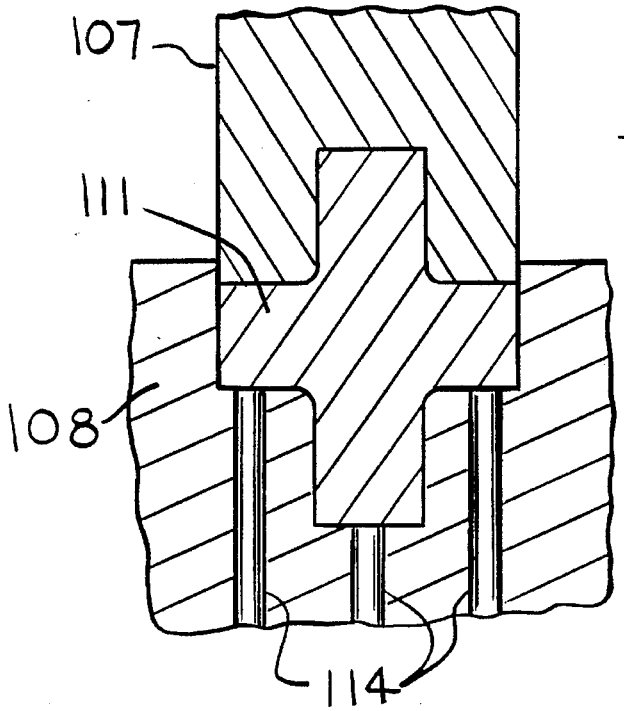
FIG. 21 is a vertical sectional view showing the punch and die combination of FIG. 20 in a closed position and a formed, "Cross" shaped blank in the die cavity.

A punch 107 and a cooperating die 108 are shown in FIG. 20 in an open position with a billet 109 (shown in section) in a cavity 110 of the die 108 and in FIG. 21 in a closed position with a "Cross" shaped precision formed blank 111 (also shown in section) filling the cavity of the die 108. The top of the billet 109 extends slightly above a surface 112 of the die 108 when the press is in the open position shown in FIG. 20. When the punch 107 is lowered from the position shown in FIG. 20, it first deforms the billet slightly and then, with further advancement, its sidewalls telescope within the cavity, forming a relatively tight seal with the walls of the die 108 which surround the cavity 110, causing further deformation thereof to form the horizontal legs of the "Cross", and extrusion of the deformed billet to form both of the vertical legs, i.e., into the die 108 to form the bottom leg and into the cavity 113 to form the top leg. The apparatus includes ejector rods 114 to force the finished blank from the cavity 110, usually as the punch 107 is being withdrawn to its open position. The billet 109 can have any desired external shape which is compatible with precision forming, and the precision formed cross-shaped blank 111 can have any desired exterior configuration.

Figure 22:
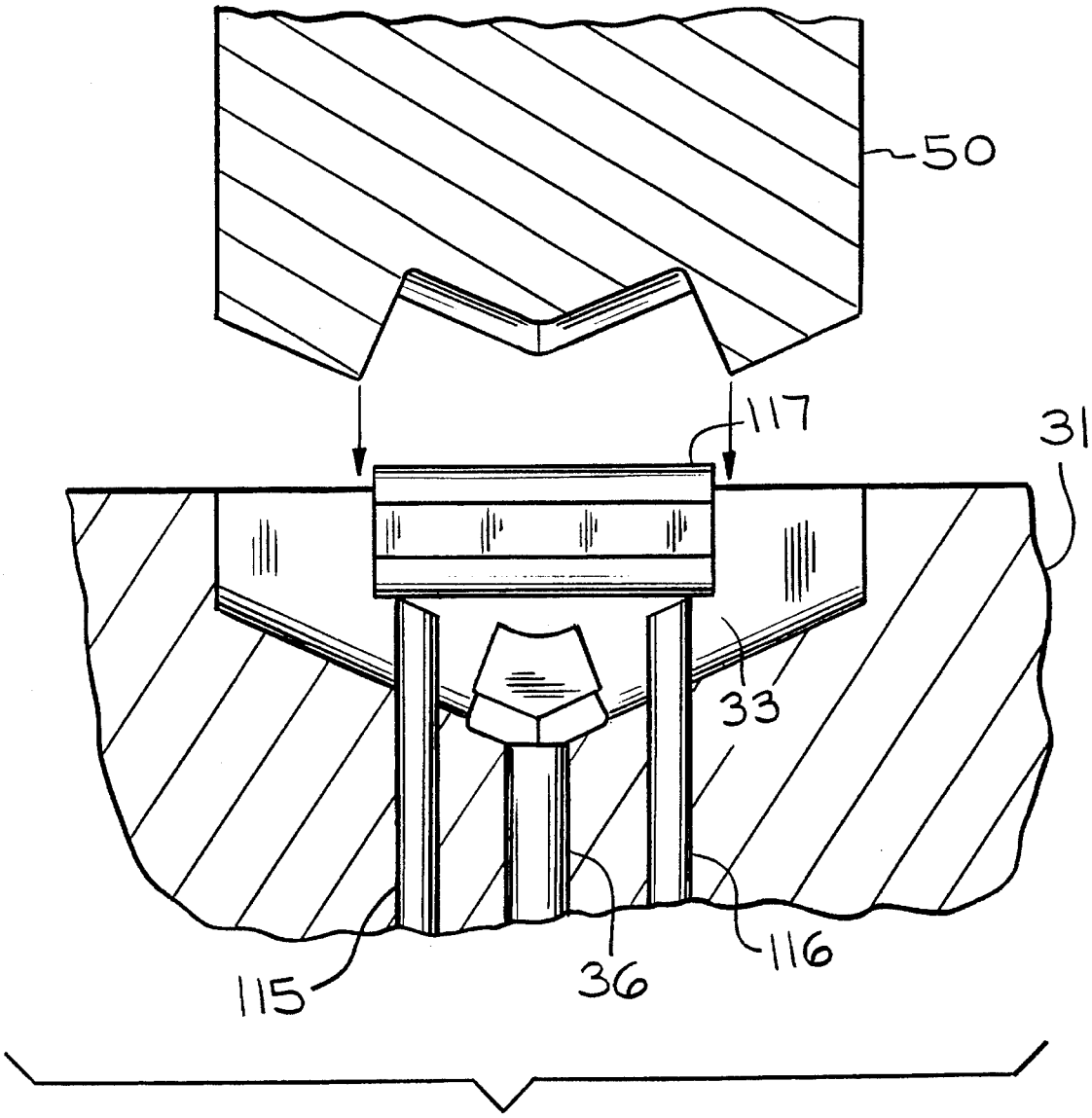
FIG. 22 is a view in vertical section showing a punch and die combination, in an open position, that is a modification of the apparatus shown in FIGS. 4 and 5.

Apparatus similar to that shown in FIG. 4, as indicated by the use of the same reference numerals for the parts that are the same, is shown in FIG. 22. The apparatus comprises the punch 50, the die 31, the cavity 33, the ejector rod 36 and locator pins 115 and 116, which cradle a billet 117. The locator pins are spring loaded against a stop (not illustrated) to the positions shown. When the punch 50 is moved downwardly toward the closed press position, it strikes the billet 117 and drives it and the locator pins 115 and 116 downwardly until the locator pins 115 and 116 and the bottom of the billet reach the bottom of the cavity. Stops (not illustrated) prevent the locator pins from moving below the bottom of the cavity while further movement of the punch 50 causes the billet to be deformed to the shape of the cavity formed by the die 31 and the punch 50. As the apparatus is opened again and the ejector rod 36 is raised, the precision formed blank (not illustrated) is driven from the cavity 33, and the spring loaded locator pins return to the position shown.

It will be noted that the locator pins 115 and 116 support the billet 117 at such a level that an upper surface thereof extends above an upper surface of the die 31, and that the cavities in the dies 31, 43, 54, 61, 69, 79, 95, 101 and 108 of FIGS. 2, 3, 4, 5, 6, 7, 8, 9, 10, 11, 12, 13, 14, 15, 16, 17, 18, 19, 20 and 21 are sufficiently shallow that upper surfaces of the billets 22, 40, 48, 55, 62, 70, 80, 102 and 109 extend in a similar manner above the corresponding upper surfaces of the dies in which they are formed. This is a preferred arrangement (and is also shown in the drawings which are subsequently described herein) because it enables the use of an infra red, visible light, ultra violet or the like beam and a sensor, or any other sensing device, to determine whether or not there is a billet in the cavity. However, apparatus in which billets are wholly within die cavities in which they are loaded can also be used in combination with different sensing means.

Figure 23:
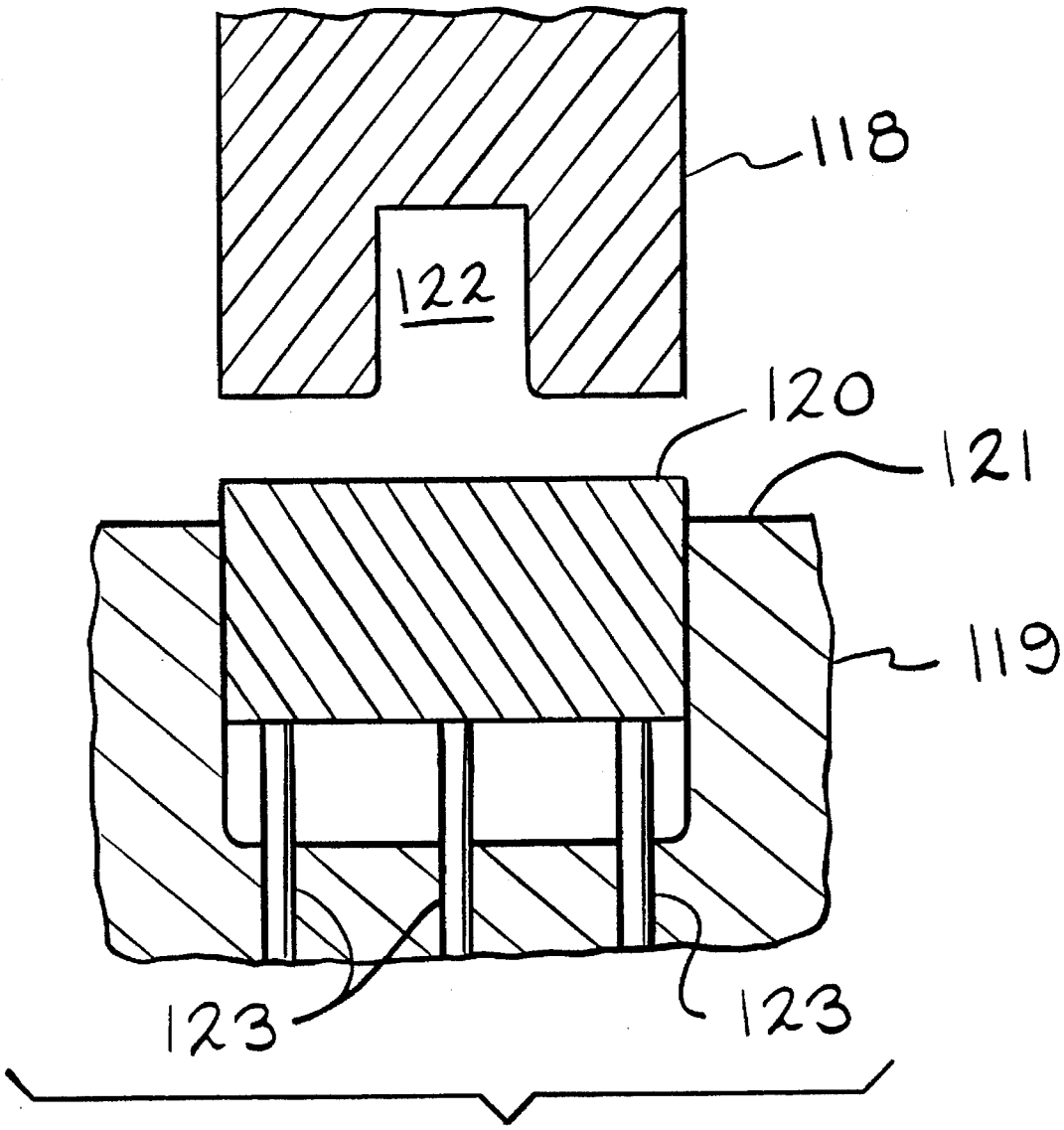
FIG. 23 is a vertical sectional view showing a punch and die combination, in an open position, that is a modification of the apparatus of FIGS. 18 and 19.

A punch 118 and a cooperating die 119 are shown in FIG. 23 in an open position with a billet 120 (shown in section) in a cavity of the die 119. The top of the billet 120 extends slightly above a surface 121 of the die 119 when the press is in the open position shown. When the punch 118 is lowered from the position shown in FIG. 23, it first deforms the billet slightly and then, with further advancement, its sidewalls telescope within the cavity, forming a relatively tight seal with the walls of the die 119 which surround the cavity. Additional movement of the punch 118 causes further deformation of the billet 120 and extrusion thereof into the cavity 122 to form an inverted "T". The apparatus includes ejector rods 123 to force the finished blank from the cavity in the die 119, usually as the punch 118 is being withdrawn to its open position. The billet 118 can have any desired external shape which is compatible with precision forming, and the precision formed inverted T-shaped blank (not illustrated) that is formed can have any desired exterior configuration.

Figure 24:
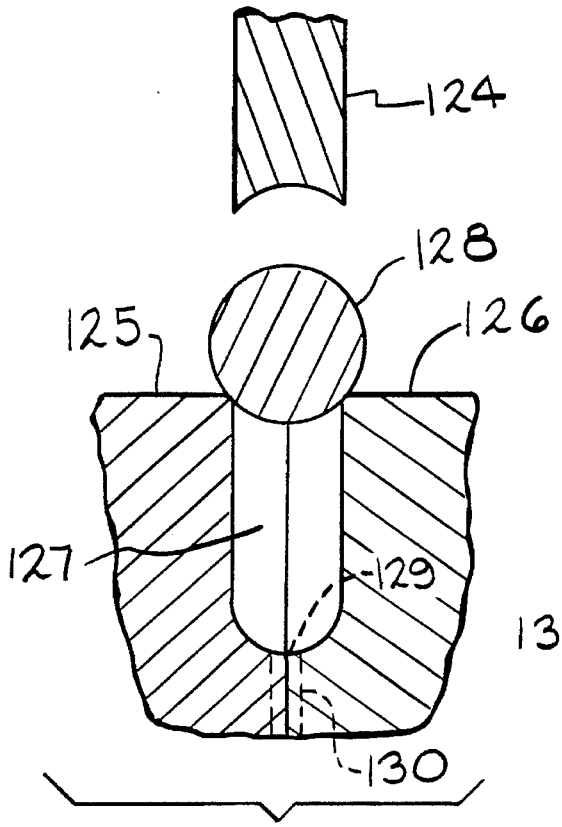
FIG. 24 is a view in vertical section showing a punch and a split die combination, with the split die in a closed position and the punch in an open position relative to the split die, and a billet in position to be dropped into the split die.
Figure 25:
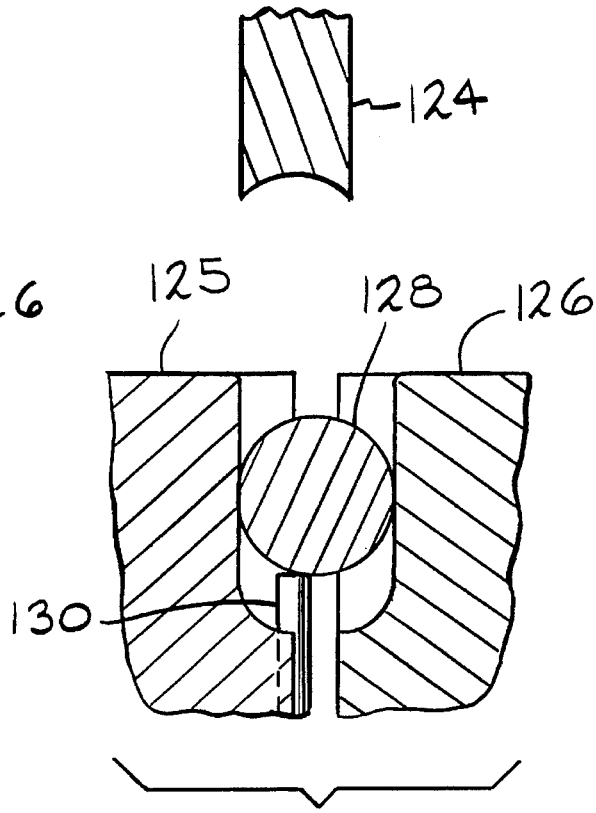
FIG. 25 is a vertical sectional view showing the punch and split die combination of FIG. 24, with the split die and the punch in open positions, and a billet in the split die in position to be precision formed.
Figure 26:
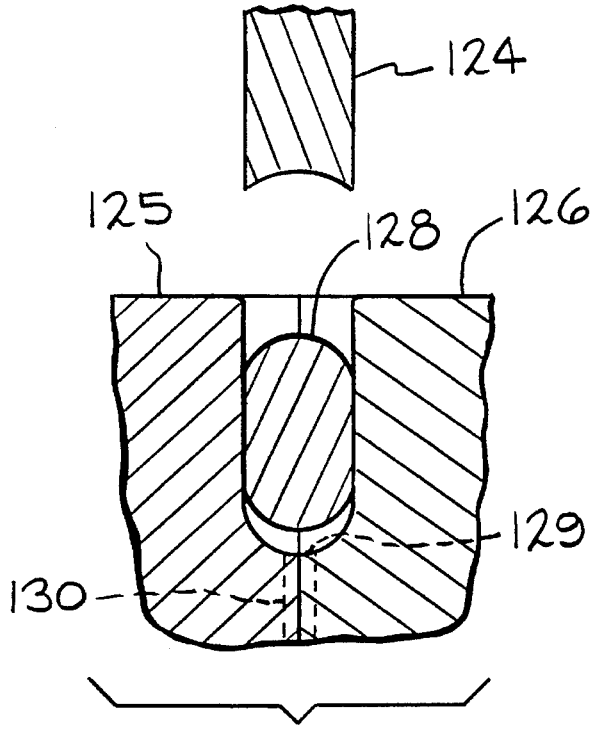
FIG. 26 is a view in vertical section showing the punch and split die combination of FIG. 24, with the split die in a closed position and the punch in an open position relative to the split die, and the billet shown in FIGS. 24 and 25 in a partially formed condition as a consequence of the closing of the split die.
Figure 27:
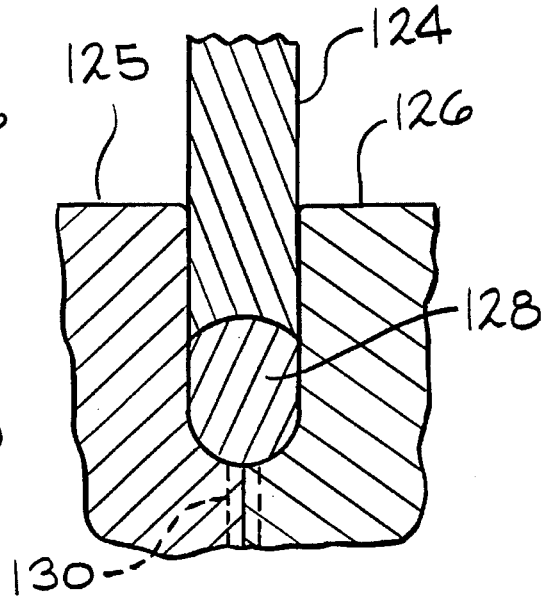
FIG. 27 is a vertical sectional view showing the punch and split die combination of FIG. 24, with both the split die and the punch in closed positions, and a precision formed blank in a cavity formed in part by walls of the split die and in part by walls of the punch.

A punch 124 and a cooperating split die having a stationary part 125 and a movable part 126 are shown in FIG. 24 in an open position relative to one another and with the split die in a closed position in which the movable part 126 nearly abuts the stationary part 125 and there is a die cavity 127 formed partly by walls of the die part 125 and partly by walls of the die part 126. A billet 128, which is circular in cross section, rests at the top of the cavity 127. The movable die part 126 is driven between the closed position shown in FIG. 24 and an open position shown in FIG. 25. Upper surfaces 129 of ejector rods 130 (one of which is shown in FIGS. 24–27) are flush with the bottom of the cavity 127 when the die parts are closed (FIG. 24), and may extend above the bottom of the cavity 127 when the die parts are open (as shown in FIG. 25) to support the billet 128 at the intermediate level in the cavity shown in FIG. 25. After the heated billet 128 has been placed in the cavity 127 with the split die in the closed position shown in FIG. 24, the die is opened and the ejector rods are raised to support the billet 128 as shown in FIG. 25. The die is then closed, flattening the sides of the billet 128 and the ejector rods 130 are lowered to the position shown in FIG. 26. When the punch 124 is lowered from the position shown in FIGS. 24, 25 and 26 to the position shown in FIG. 27, it precision forms the billet as previously described to the shape of the cavity formed by the stationary die part 125, the movable die part 126 and the punch 124. The ejector rods 130 are raised to force the finished blank from the cavity 127, usually as the punch 124 is being withdrawn to its open position shown in FIG. 24. The die parts 125 and 126, it will be appreciated, can both be moved between closed and open positions, and hydraulic, mechanical, or other means can be used to cause the movement of one or both of the die parts. Similarly, while a split die composed of a stationary part and a movable part is shown in FIGS. 24–27, it will be appreciated that, in fact, it will sometimes be advantageous to maintain the symmetry of the die by moving both parts.

Figure 28:
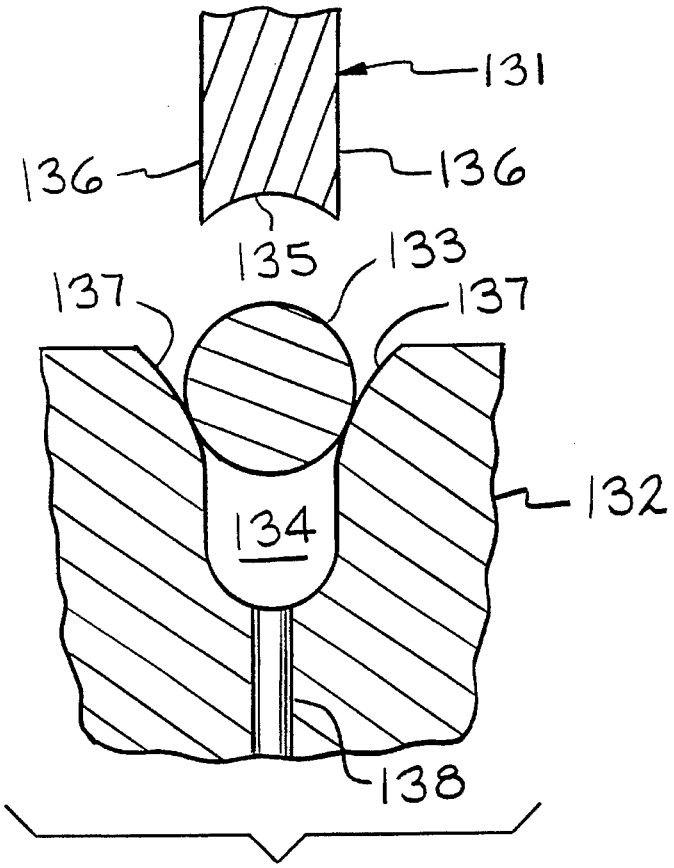
FIG. 28 is a view in vertical section showing still another punch and die combination, in an open position, and a billet in position to be forced into the die.
Figure 29:
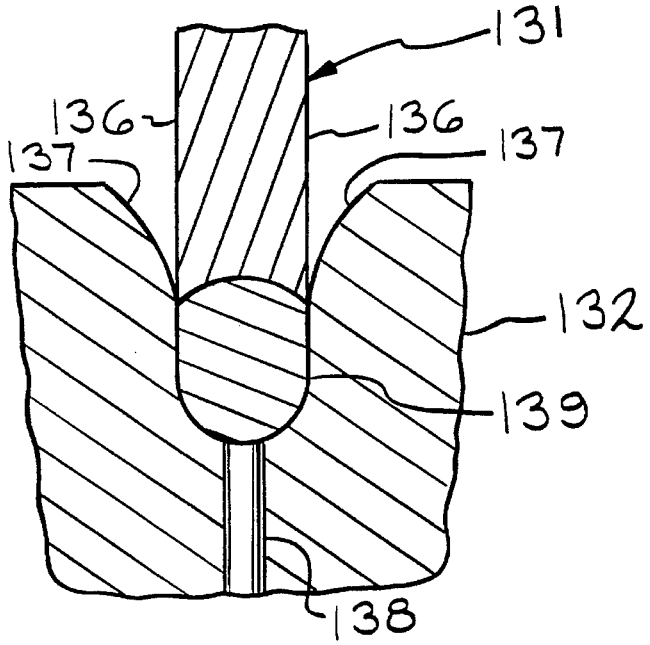
FIG. 29 is a vertical sectional view showing the punch and die combination of FIG. 28, in a closed position, with a precision formed blank in a cavity formed in part by walls of the die and in part by walls of the punch.

A punch indicated generally at 131 and a die 132 are shown in FIG. 28 in an open position with a billet 133 in a cavity 134 of the die 132. The punch 131 has a central forming portion 135 and vertically extending walls 136 which extend upwardly from the edges of the forming portion 135. The billet 133 is circular in cross-section and has a diameter greater than the lateral width (left to right) of the lower portion of the cavity 134 into which it must be forced to produce a precision formed blank. When the punch 131 is moved downwardly from the position shown, the forming portion 135 makes contact with the billet 133 and, shortly thereafter, the surfaces 136 of the punch 131 move between surfaces 137 of the die 132 so that the entire billet 133 is forced into the cavity 134. The surfaces 137, at their lower extremities, are extensions of the sidewalls which are adjacent (left and right) the cavity 134 (FIG. 28) and then curve outwardly to the top of the die 132. The apparatus includes ejector rods 138 (one of which is shown in FIGS. 28 and 29) to urge a precision formed blank 139 (FIG. 29) from the cavity 134, usually as the punch 131 is being moved upwardly from the die 132 to the position shown in FIG. 28.

Figure 30:
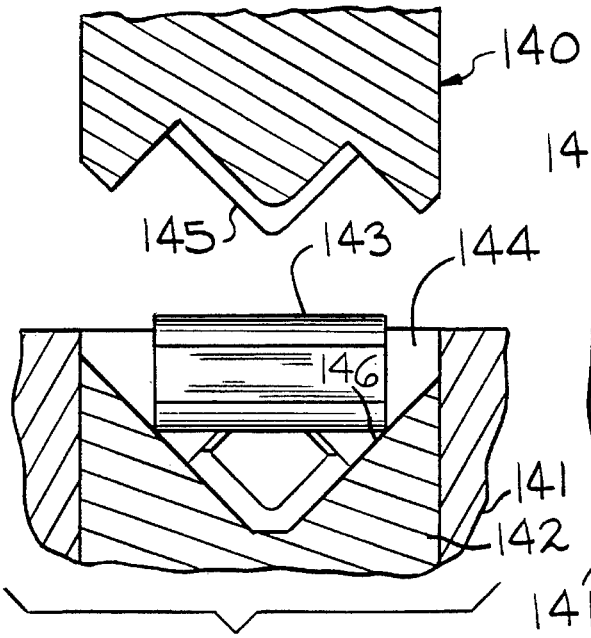
FIG. 30 is a view in vertical section showing a punch, die and anvil combination, in an open position, and a billet in position to be precision formed.
Figure 31:
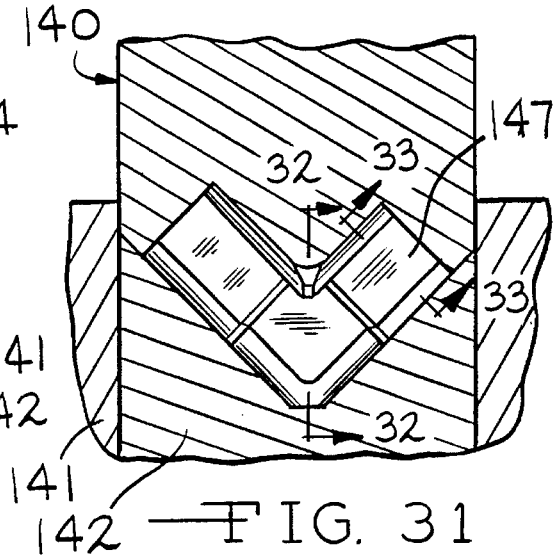
FIG. 31 is a vertical sectional view showing the punch, die and anvil combination of FIG. 30, in a closed position, with a precision formed blank in a cavity formed in part by walls of the punch, in part by walls of the die and in part by walls of the anvil.
Figure 32:
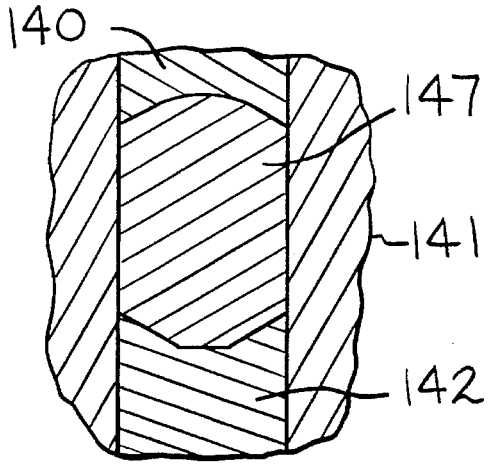
FIG. 32 is a view in vertical section taken along the line 32—32 of FIG. 31.
Figure 33:
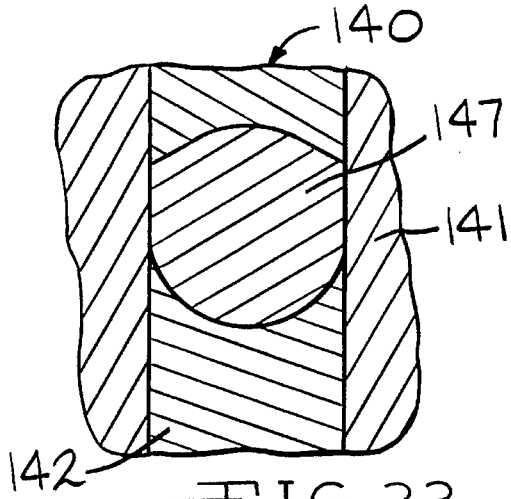
FIG. 33 is a vertical sectional view taken along the line 33—33 of FIG. 31.

A punch indicated generally at 140, a die 141 and an anvil 142 are shown in FIG. 30 with the punch 140 in an open position relative to the die 141 and the anvil 142. A billet 143 is shown in a cavity 144 which extends through the die 141. The punch 140 has a central forming portion 145, while the anvil has an upper forming portion 146. When the punch 140 is lowered from the open position shown in FIG. 30 to the closed position shown in FIG. 31, the billet 143 is precision formed as previously described in a cavity which is within the cavity 144 of the die 141, and closed at the top by the central forming portion 145 of the punch 140 and at the bottom by the upper forming portion 146 of the anvil 142. The anvil 142 can be raised from the position shown in FIGS. 30, 31, 32 and 33 so that it can lift a precision formed blank 147 (FIGS. 31, 32 and 33) from the cavity 144 in the die 141, usually as the punch 140 is being moved upwardly from the die 141 to the position shown in FIG. 30.

Figure 34:
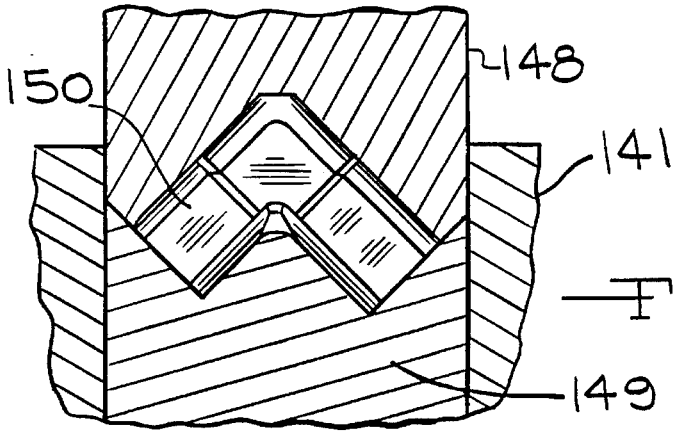
FIG. 34 is a view in vertical section showing the die of FIGS. 30–33 in combination with a different punch and anvil; the three are in a closed position, with a precision formed blank in a cavity formed in part by walls of the punch, in part by walls of the die and in part by walls of the anvil.

A different punch 148 is shown in FIG. 34 in a closed position relative to the die 141 and a different anvil 149, with a precision formed blank 150 in a cavity formed by walls of the punch 148, walls of the die 141, and walls of the anvil 149.

While the ejector rods 34, 35, 36, 45, 59, 64, 77, 93, 99, 106, 114, 123, 130 and 138 of FIGS. 2, 3, 4, 5, 6, 8, 9, 10, 15, 16, 17, 18, 19, 22, 23, 24, 2.5, 26, 27. 28 and 29 are all shown as circular in cross section, it will be appreciated that any other cross sectional shape can be used, e.g., square, rectangular, oval or the like, but that circular is usually preferred because of the greater ease of providing circular passages in the dies through which they must move. The same is true of the locator pins 115 and 116 of FIG. 22.

Figure 35:
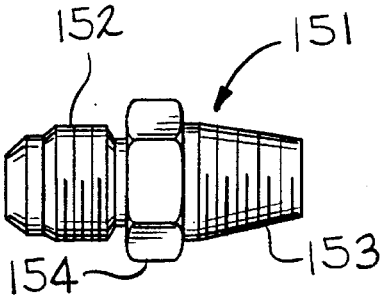
FIGS. 35 through 40 are plan views showing examples of fittings for hydraulic, pneumatic or the like systems that can be produced by machining blanks that can be precision formed according to the present invention.

A straight tube to pipe fitting is indicated generally at 151 in FIG. 35. The fitting 151 has a tube thread 152, a pipe thread 153, and a central, wrench-receiving hex 154.

Figure 36:
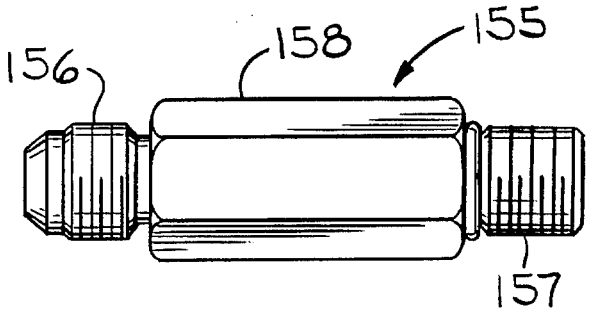

A straight tube to S.A.E. "O" ring boss fitting is indicated generally at 155 in FIG. 36. The fitting 155 has a tube thread 156, an "O" ring boss thread 157 and a central, wrench-receiving hex 158.

Figure 37:
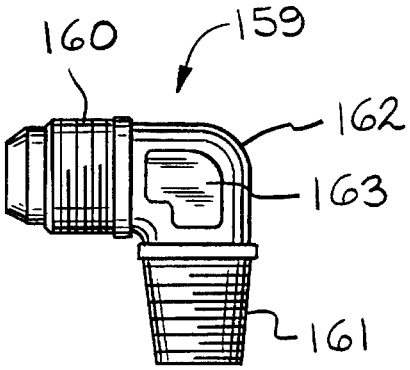

A 90° tube to pipe fitting is indicated generally at 159 in FIG. 37. The fitting 159 has a tube thread 160, a pipe thread 161, a central body portion 162 and a pair of parallel, wrench receiving surfaces, one of which is shown, designated 163.

Figure 38:
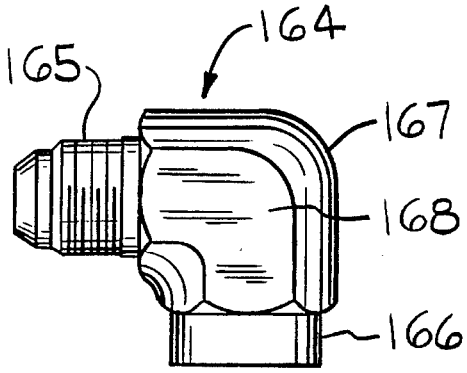

Another 90° tube to pipe fitting is indicated generally at 164 in FIG. 38. The fitting 164 has a tube thread 165, an end 166 which has internal pipe threads, a central body portion 167 and a pair of parallel, wrench receiving flats, one of is shown, designated 168.

Figure 39:
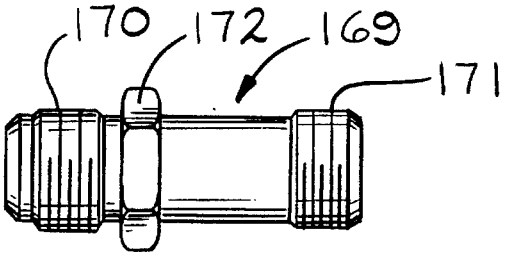
Figure 40:
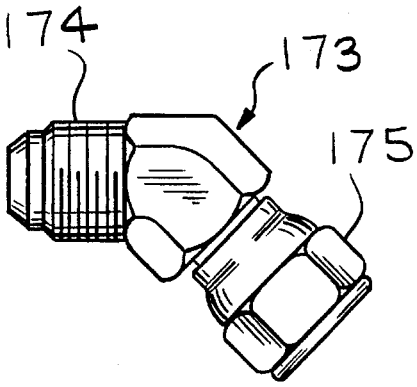

A straight tube to brake cylinder fitting is indicated generally at 169 in FIG. 39. The fitting 169 has a tube thread 170, a brake cylinder thread 171 and a wrench-receiving hex 172.

A 45° tube to tube union fitting is indicated generally at 173 in FIG. 443. The fitting 173 has a tube thread 174 and a wrench receiving hex end 175 with internal tube-union threads.

The fittings 20, 151, 155, 159, 164, 169 and 173 (FIGS. 1 and 35–40) are only examples of the kinds of fittings that can be fabricated by machining precision formed blanks produced in accordance with the present invention, as many other fittings are known and can be produced from suitable precision formed blanks.

Figure 41:
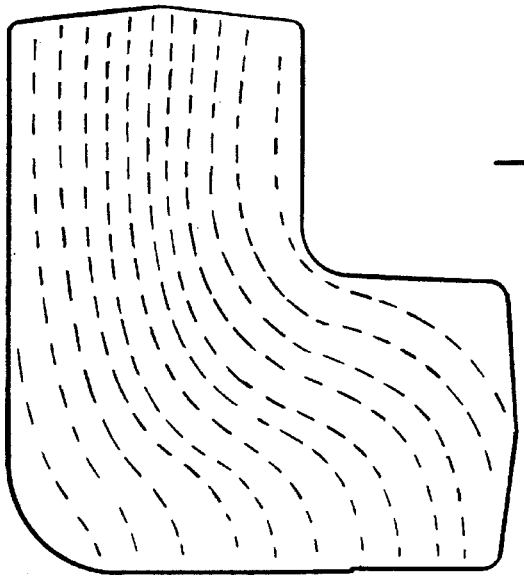
FIG. 41 is a schematic representation of a photomicrograph showing the grain structure of a forged blank from which machined fittings have heretofore been produced by machining.

FIG. 41 is a representation of a photomicrograph of a section of a conventionally forged blank which had a shape similar to that of the precision formed blank 46 of FIGS. 8–11. The forged blank was cut into two pieces along a plane through the longitudinal axes of the two portions of the blank. The lines in FIG. 41 represent the orientation of the grains of the blank. It will be noted that the grains were oriented longitudinally of one part of the blank, but that the orientation was lateral of the second part. The forged part was produced from bar or rod stock which had longitudinally oriented grains as a consequence of the process by which it was manufactured. During forging, however, the orientation was changed to that shown in FIG. 41 as a consequence of lateral metal flow. Such orientation has been found to be typical of forged parts, although the portion of the blank where lateral grain orientation indicative of lateral metal flow appears varies, depending upon die configuration.

Figure 9:
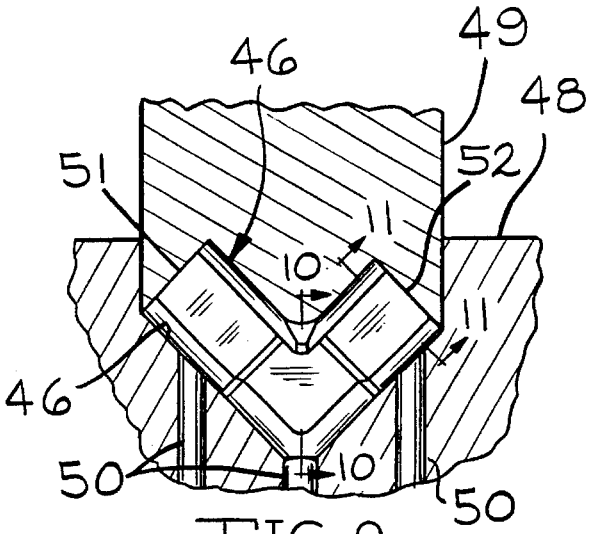
FIG. 9 is a vertical sectional view showing the punch and die of FIG. 8 in a closed position and a formed blank in the die cavity.
Figure 10:
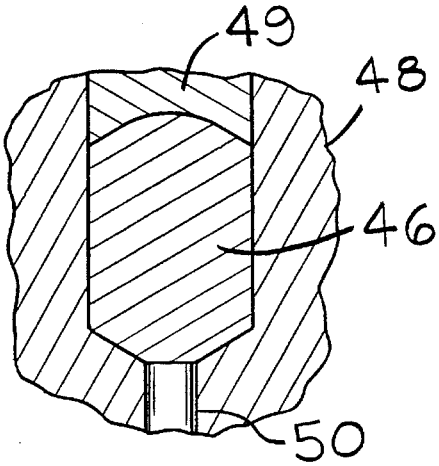
FIG. 10 is a view in vertical section taken along the line 10—10 of FIG. 9.
Figure 11:
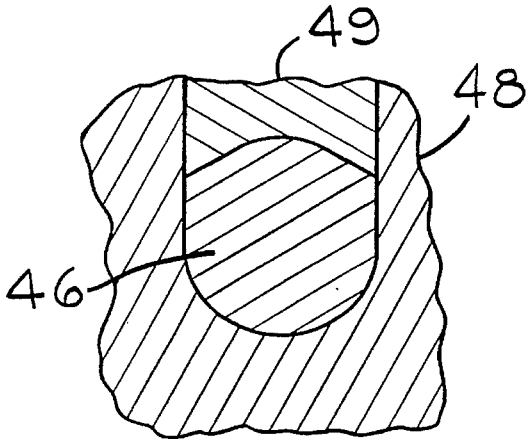
FIG. 11 is a vertical sectional view taken along the line 11—11 of FIG. 9.
Figure 42:
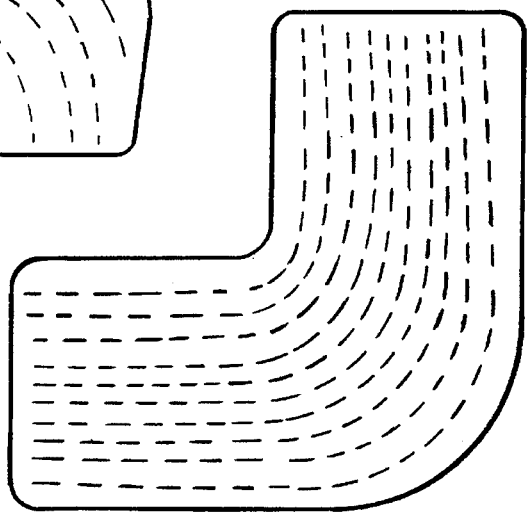
FIGS. 42 and 43 are schematic representations of photomicrographs showing the grain structures of two different blanks that have been precision formed according to the instant invention; machined fittings according to the invention for hydraulic or the like systems can be produced from the precision formed blanks whose microstructures are shown in FIGS. 42 and 43.

FIG. 42 is a representation of a photomicrograph of a section of the precision formed blank 41 of FIGS. 9–11. The precision formed blank was cut into two pieces along a plane through the longitudinal axes of the two portions of the blank. The lines in FIG. 42 represent grain orientation in the precision formed blank, which remains longitudinal of the blank because precision forming does not alter the longitudinal orientation of the steel from which the blank was precision formed. It will be noted that the grain orientation was longitudinal throughout the precision formed blank. Such orientation has been found to be typical of precision formed blanks.

Figure 43:
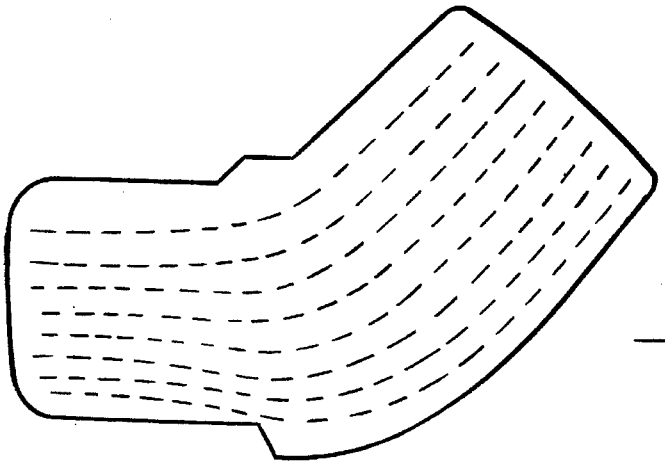

FIG. 43 is a representation of a photomicrograph of a section of the precision formed blank 21 of FIG. 1. The precision formed blank was cut into two pieces along a plane through the longitudinal axes of the two portions of the blank. The lines in FIG. 43 represent grain orientation in the precision formed blank, which remains longitudinal of the blank because precision forming does not alter the longitudinal orientation of the stock from which the blank was precision formed. It will be noted that the grain orientation was longitudinal throughout the precision formed blank. Such orientation, as is stated above, has been found to be typical of precision formed blanks. The longitudinal orientation is also retained in fittings (e.g., that designated 20 in FIG. 1) produced by machining from the precision formed blanks, and is important because it strengthens the fittings by comparison with otherwise identical fittings machined from dimensionally identical blanks produced by the prior art forging techniques (see FIG. 41) where suitable metal stock is heated to an appropriate temperature and forged between a series of matched dies and punches to a plurality of successive shapes, the last of which is the desired blank with relatively heavy flash surrounding it along the die-punch parting line. Because of the metal flow in the drop forging operation away from, and to the edges of, the portion of the metal stock which ultimately becomes the blank, where much of the metal which flowed becomes the flash, the grain orientation is changed by forging of the blank, and there is consistently lateral, rather than axial, grain orientation in at least some portions of a forged blank. The same grain orientation appears in the fitting that is produced by machining a forged blank.

Figure 44:
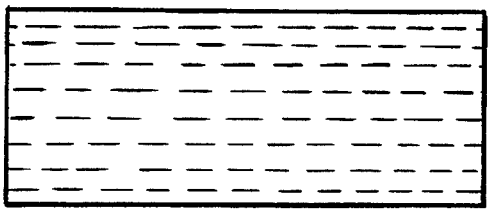
FIG. 44 is a schematic representation of a photomicrograph showing the grain structure of bar or rod stock from which precision formed blanks according to the present invention and forged blanks of the prior art can be produced.

FIG. 44 is a representation of a photomicrograph of a section of a length of bar or red stock. The stock was cut into two pieces along a plane through its longitudinal axis. The lines in FIG. 44 represent grain orientation in the stock, which is longitudinal as a consequence of the forming operation by which the stock was produced. Straight fittings having generally the shape, for example, of those designated 151, 155 and 169 in FIGS. 35, 36 and 39, have been produced by machining bar or rod stock. The grain of such fittings is longitudinal because there is no forging operation to change the grain orientation of the original stock. So far as is known, however, all fittings for hydraulic, pneumatic and the like systems, which fittings have at least two longitudinally extending portions with axes which interect at an angle of 165° or less (195° or more in the opposite direction) have previously been made by machining conventionally forged blanks, and have had microstructures analogous to that shown in FIG. 41. Therefore, a fitting according to the present invention is believed to be novel when it has at least two longitudinally extending portions with longitudinal axes which intersect at an angle of 165° or less and the grains are oriented longitudinally of the two or more portions.

Accordingly, in one aspect the instant invention is an improvement in apparatus for precision forming, which apparatus comprises a die with a cavity which conforms with the shape of a portion of a part to be formed, a punch with a cavity which conforms with the shape of another portion of the part to be formed, and means for causing relative movement of the die and the punch between (a) a first position in which the die and the punch nearly abut one another and the two cavities are aligned and form a single cavity which conforms with the shape of the part to be formed, and (b) a second position in which the die and the punch are separated from one another and a blank can be placed in the cavity of one to be die formed, when the two are returned to the first position, to the shape of the single cavity.

The present improvement is that, disregarding shrinkage, the cavity in one of the die and the punch is bounded by walls which conform with the shape of a portion of the part to be formed, including longitudinally opposed end walls in their entirety, while the cavity in the other is bounded by walls which conform with the shape of the rest of the part to be formed, but no portion of the longitudinally opposed end walls, whereby the length of a part to be formed is determined by the spacing between the walls of the die or punch which conform with the shape of the longitudinally opposed end walls, and can be changed by substituting a die or punch, as the case may be, in which this spacing is different.

In another aspect, the invention is an improvement in such apparatus wherein the cavity in the die is bounded by walls which conform with the shape of a portion of the part to be formed, and is sufficiently deep that a billet having a suitable volume to be precision formed and a suitable shape can be placed in the cavity so that it is at least substantially completely contained therein, while the cavity in the punch is bounded by walls which conform with the shape of the rest of the part to be formed, and wherein the exterior of the punch and the interior of the die have shapes which enable the former to telescope within the latter so that, when a billet is in the die cavity and there is relative movement between the punch and the die from the second to the first position, the billet is confined within the cavity formed by the die and the punch before the first position is reached, and, as a consequence of the confinement, the punch is capable of applying to the billet a force greater than that required to cause deformation of the billet. This greater force is required to cause extrusion, e.g., of metal into the bottom leg of the "Y" of FIGS. 12 and 13.

In still another embodiment, the invention is a formed blank or a fitting for a hydraulic, pneumatic or the like system machined from the blank, which blank or fitting has at least two longitudinally extending portions with axes which intersect one another at an angle not greater than 165°, and a microstructure in each such portion wherein substantially all of the grain is oriented parallel to the longitudinal axis of that portion.

In yet another embodiment the invention is a method for producing a longitudinally extending part by precision forming in a press having a die with a cavity which conforms with the shape of a portion of the part to be produced and a cooperating punch with a cavity which conforms with the shape of another portion of the part. The punch and the die are relatively movable between:

(a) a first position in which the die and the punch nearly abut one another and the two cavities are aligned and form a single cavity which conforms with the shape of the part to be formed, and (b) a second position in which the die and the punch are separated from one another and a billet can be placed in the cavity of one to be formed, when the two are returned to the first position, to the shape of the single cavity.

The cavity has a minimum dimension of X between opposed walls which extend in the direction of punch/die relative movement, and between which a billet must pass to enter the cavity. The method comprises the steps of producing an appropriate billet having a maximum dimension in a given direction less than X, placing the billet in the die, while the punch and the die are in the second position, so that punch/die relative movement will force the part of the billet having the maximum dimension less than X between the opposed walls where the cavity has the minimum lateral dimension of X, and causing relative movement between the punch and the die to the first position.

In yet another aspect the invention is an improvement in apparatus for precision die forming, which apparatus comprises a die with a cavity which conforms with the shape of a portion of a longitudinally extending part to be formed, a punch with a cavity which conforms with the shape of another portion of the part to be formed, and means for causing relative movement of the die and the punch between (a) a first position in which the die and the punch nearly abut one another and the two cavities are aligned and form a single cavity which conforms, at the temperature of formation, with the shape of the part to be formed, and (b) a second position in which the die and the punch are separated from one another and a billet can be placed in the cavity of one to be formed, when the two are returned to the first position, to the shape of the single cavity.

The present improvement is that the cavity in one of the die and the punch is bounded by walls which conform with the shape of a portion of each of a plurality of the parts to be formed, while the cavity in the other is bounded by walls which conform with the shape of the rest of each of a plurality of the parts to be formed, the plurality of parts differing from one another with respect to the length of the longitudinally extending part, but neither the punch nor the die has walls which form longitudinally opposed end walls of the part, whereby the length of a part to be formed is determined by the weight or volume of a billet that is precision formed in the apparatus.

In still another aspect the invention is apparatus for precision forming, which apparatus comprises a die having a cavity, a first part of which conforms with the shape of a portion of a part to be formed, and a second part of which diverges away from such first part, a punch with a cavity which conforms with the shape of another portion of the part to be formed, means for causing relative movement of the die and of the punch between (a) a first position in which the punch extends through the second part of the cavity of the die, the die and the punch nearly abut one another, and the first part of the cavity of the die and the cavity of the punch are aligned and form a single cavity which conforms, at the temperature of formation, with the shape of the part to be formed, and (b) a second position in which the die and the punch are separated from one another, the second cavity of the die is between the first cavity of the die and the cavity of the punch, and a billet can be placed in the second cavity of the die to be formed, when the two are returned to the first position, to the shape of the single cavity, plates on opposite sides of the cavity of the punch, mounted for sliding movement relative to the punch in a direction parallel to the direction of relative movement between the die and the punch, and means urging the plates toward the die. The plates are so positioned that, during relative movement between the die and the punch, surfaces thereof bear upon the walls which form the second cavity of the die, and confine metal that would otherwise be scarfed from a billet, with the result that such metal is forced into the second cavity of the die by the punch.

In yet another aspect the invention is apparatus for precision forming which comprises a punch and a cooperating die composed of a plurality of die parts. The die parts are supported for limited movement relative to one another between a first open position and a second closed position. Each of the die parts has walls which surround a partial die cavity in that part. The punch and the cooperating die are mounted for limited movement relative to one another between an open punch/die position and a closed punch/die position. When the punch and the die are in a closed punch/die position, and the die parts are in the second closed position, at least one wall of the punch and the walls of the die parts which surround the partial die cavities in the die parts, enclose a cavity which has the shape required for precision forming of a desired part. When the die parts are in the first open position, the walls of the die parts which surround the partial die cavities in the die parts form a partially closed cavity into which a billet can be placed and collapsed laterally by relative movement of the die parts to the second closed position before relative movement between the punch and the die to the closed punch/die position.

The invention, in still another aspect, is apparatus for precision forming which includes a die having a cavity which conforms with the shape of a portion of a part to be formed, and a punch with a cavity which conforms with the shape of another portion of the part to be formed. The punch and the die are mounted for limited movement relative to one another between an open punch/die position and a closed punch/die position. The punch and the die nearly abut one another when in the closed position, and form a single cavity which conforms, at the temperature of formation, with the shape of the part to be formed; when in the open position, the die and the punch are separated from one another, and a billet can be placed adjacent the cavity of the die to be formed, when the two are returned to the closed position, to the shape of the single cavity. The apparatus also has an ejector pin which is movable relative to the die between a first position where a given surface of the pin adjoins a portion of the cavity of the die and a second position where the given surface extends into the cavity of the die, and an embossed or depressed indicium on the given surface so that a reversal of the indicium appears on a part precision formed in the apparatus.

The invention, in yet another aspect, is apparatus for precision forming which includes a die with a cavity extending therethrough, the walls which surround the cavity conforming with the shape of a portion of a part to be formed, a punch having a surface which conforms with the shape of another portion of the part to be formed, and an anvil having a surface which conforms with the shape of the rest of the part to be formed. The punch and the die are mounted for movement relative to one another and the anvil and the die are mounted for movement relative to one another. In a closed position, a part of the punch, a part of the die and a part of the anvil form a single closed cavity which has the shape of a part to be precision formed in the apparatus. In an open position, a billet can be positioned so that it will be precision formed during relative movement to the closed position. The die and the anvil can also be mounted for movement relative to one another for the purpose of ejecting a precision formed part from the cavity of the die.

In still another aspect the invention is apparatus for precision forming which includes a die having several cavities, each of which has a part which conforms with the shape of a portion of a part to be formed, and a plurality of punches, each of which has a cavity which conforms with the shape of another portion of a part to be formed in one of the die cavities. The die and the punches are mounted for simultaneous relative movement between an open position and a closed position. In the closed position, each of the punches nearly abuts one of the die cavities and forms therewith a single cavity which conforms, at the temperature of formation, with the shape of a part to be formed, while, in the closed position, the die and each of the punches are separated from one another, and a billet can be positioned to be precision formed in each of the cavities when the die and the punches are returned to the closed position, to the shape of the single cavity.

In yet another aspect, the invention is apparatus for precision forming a shape which includes a central body and opposed legs extending in a given direction from the central body. The apparatus has a die with a cavity which conforms with the shape of a portion of the part to be formed, and a cooperating punch with a cavity which conforms with the shape of another portion of the part to be formed. The punch and the die are mounted for relative movement in the given direction between a closed position and an open position. In the closed position the punch and the die nearly abut one another, and the cavity of the die and the cavity of the punch are aligned and form a single cavity which conforms, at the temperature of formation, with all of the shape of the part to be formed except the ends of the legs. In the open position the die and the punch are separated from one another, and a billet can be positioned to be precision formed by the punch and the die when the two are returned to the closed position, to the shape of the single cavity. There are also plates on opposite sides of the cavity of the punch, mounted for sliding movement relative to the punch in a direction parallel to the direction of relative movement between the die and the punch, and resiliently urged toward the die. The plates are so positioned that, during relative movement between the die and the punch, end surfaces thereof contact and shape the ends of the legs of the part being precision formed.

In the apparatus shown in the attached drawings, and discussed in connection therewith, a punch is moved vertically between an open position and a closed position relative to a stationary die. It will be appreciated that the punch could equally well be stationary, in which case the die would be moved vertically between open and closed positions, and that the movement of the punch, die, or both, need not be vertical, although the operation is simplified if the die is positioned so that gravity keeps a billet placed therein in a desired position.

In the foregoing description of the invention, reference has been made repeatedly to billets heated to a suitable temperature as being placed in a cavity for precision forming. A temperature of 1400° F. (760° C.) is a desirable billet temperature for precision forming of carbon steels, although temperatures ranging from 1200° to 2000° F. (650° to 1095° C.), 1200° to 1800° F. (650° to 980° C.) with low carbon steels, have been used. The higher temperatures in these ranges are relatively unsatisfactory, because both decarburization and scaling are encountered, necessitating a descaling operation and the production of a sufficiently large precision formed blank that the removal of the decarburized surface during the machining operation by which a fitting is produced whenever a substantially constant carbon content is required. Temperatures in the range of 1000° to 2100° F. (540° to 1150° C.) are satisfactory with billets of brass, stainless steels, monel, inconel, and titanium alloys.

An important advantage of precision forming blanks according to the present invention is the absence or substantial absence of flash on the blanks. This contrasts with blanks produced by drop forging, which presently is the method generally in use, where somewhere in the vicinity of twenty five percent of the metal of the original stock is formed into flash.

It will be apparent that various changes and modifications are possible from the specific details of the instant invention as shown in the attached drawings and described with reference thereto without departing from the spirit and scope of the attached claims.

We claim:

1. In apparatus for precision forming, which apparatus comprises a die with a cavity bounded by walls, a plurality of interchangeable punches each with a cavity bounded by walls for selected use with the die, and means for causing relative movement of the die and any selected one of the punches in a given direction between (a) a first position in which the die and the selected one of the punches abut or nearly abut one another and the two cavities are aligned and the walls which bound the die cavity and the cavity of the selected one of the punches form a single cavity, and (b) a second position in which the die and the selected one of the punches are separated from one another and a billet can be placed in the cavity of one to be die formed, when the two are returned to the first position, to the shape of the single cavity, the improvement wherein the die forms with each of the interchangeable punches, when the punch is selected and the die and the selected punch are in the first position relative to one another, a single cavity which has a central region, a first longitudinally extending portion which extends outwardly in a given direction from the central region and has an end surface, and a second longitudinally extending portion which extends outwardly in a different direction from the central region and has an end surface, the two end surfaces being either parallel to the given direction of relative movement between the selected one of the punches and the die or extending at an angle other than 90° to that given direction of relative movement, the walls which bound the die cavity forming no portion of the end surfaces of the single cavity, while the walls which bound the cavity of the selected one of each of the interchangeable punches form the end surfaces in their entirety, and wherein the single cavities formed by the die and each of the interchangeable punches, when in the first position relative to one another differ from one another with respect to one or more of the distance between the two end surfaces, the length of one of the longitudinally extending portions, and the length of both longitudinally extending portions, but being otherwise identical.

2. In apparatus as claimed in claim 1 the additional improvement which includes means operable to support a billet placed in the cavity of the die or of the punch, when the two are in the second open position, above the bottom of the cavity and said support means being operable to be withdrawn from the cavity before its presence therein would interfere with precision forming of the billet.

3. Apparatus as claimed in claim 1 wherein the walls of the punch which bound the two end surfaces of the single cavity are either parallel to the given direction of relative movement between the punch and the die or extend at an angle not greater than about 45° to that given direction of relative movement.

4. Apparatus for precision forming, said apparatus comprising a die which has a cavity with a first part which is between first opposed, laterally extending die walls, and conforms with the shape of a portion of a part to be formed, and a second part which is between second opposed, laterally extending die walls which diverge away from said first opposed die walls, a punch with a cavity which conforms with the shape of another portion of the part to be formed, means for causing relative movement of said die and said punch between (a) a first position in which a part of said punch extends between said second opposed die walls, said die and said punch abut or nearly abut one another, and the first part of the cavity of said die and the cavity of said punch are aligned and form a single cavity which conforms, at the temperature of formation, with the shape of the part to be formed, and (b) a second position in which said die and said punch are separated from one another, the second cavity of said die is between the first cavity of said die and the cavity of said punch, and a billet can be placed in the second cavity of said die to be die formed, when the two are returned to the first position, to the shape of the single cavity, plates on opposite sides of the cavity of said punch, mounted for sliding movement relative to said punch in a direction parallel to the direction of relative movement between said die and said punch, and means urging said plates toward said die, said plates being so positioned that, during relative movement between said die and said punch from the second position to the first position, surfaces of said plates bear upon said second opposed die walls, and confine metal that would otherwise be scarfed from a billet.

5. Apparatus as claimed in claim 4 wherein there are inner and outer plates on each side of the cavity of said punch, mounted adjacent and parallel to one another for sliding movement relative to said punch in a direction parallel to the direction of relative movement between said die and said punch, said inner plates being closely adjacent said punch and between said outer plates and said punch, and said outer plates being closely adjacent said inner plates, and means urging said plates toward said die, said plates being so positioned that, during relative movement between said die and said punch, surfaces of the outer ones of said plates bear upon the walls which form the second part of the cavity of said die, and confine metal that would otherwise be scarfed from a billet, and, with further relative movement, surfaces of inner ones of said plates bear upon the walls which form the second part of the cavity of said die, and confine metal that would otherwise be scarfed from a billet.

6. Apparatus as claimed in claim 4 which additionally includes means operable to support a billet placed in the cavity of the die or of the punch, when the two are in the second open position, above the bottom of the cavity and said support means being operable to be withdrawn from the cavity before its presence therein would interfere with precision forming of the billet.

7. Apparatus for precision forming, said apparatus comprising a punch and a cooperating die composed of a plurality of die parts, means mounting said die parts for limited movement relative to one another between a first open position and a second closed position, each of said die parts having walls which surround a partial die cavity in that part, said punch and said cooperating die being mounted for limited movement relative to one another between an open punch/die position and a closed punch/die position, at least one wall of said punch, when said punch and said die are in a closed punch/die position, and the walls of said die parts which surround the partial die cavities in said die parts, when said die parts are in the second closed position, enclosing a forming cavity which has a central region, a first longitudinally extending portion which extends outwardly in a given direction from the central region, and a second longitudinally extending portion which extends outwardly in a different direction from the central region said means mounting said die parts being operable to move said die parts from the second closed position to the first open position by translating the walls of said die parts which surround the partial die cavities in said die parts laterally outwardly to the first open position, forming a partially closed cavity which is larger, laterally, than the forming cavity, whereby a billet having a circular cross section and a volume approximately 2 percent less than the volume of the part to be formed can be placed inside the partially closed cavity and collapsed laterally by relative movement of said die parts to the second closed position before relative movement between said punch and said die to the closed punch/die position.

8. Apparatus as claimed in claim 7 which additionally includes means operable to support a billet placed in the partially closed cavity when said die parts are in the first open position above the bottom of the cavity and to withdraw from the cavity after collapse of the billet commences during relative movement of said die parts to the second closed position.

9. Apparatus as claimed in claim 8 wherein said means operable to support a billet placed in the partially closed cavity comprises at least one vertically extending pin mounted for longitudinal sliding movement between a first position where its top is at least generally aligned with a wall which is adjacent the bottom of the cavity and a second position where it supports the billet above the bottom of the cavity, and means for moving said pin between the first and second positions.

10. Apparatus for precision forming, said apparatus comprising a die with a cavity which conforms with the shape of a portion of a part to be formed, a punch with a cavity which conforms with the shape of another portion of the part to be formed, means for causing relative movement of said die and said punch between (a) a first position in which said die and said punch abut or nearly abut one another, and the first part of the cavity of said die and the cavity of said punch are aligned and form a single cavity which conforms, at the temperature of formation, with the shape of the part to be formed, and (b) a second position in which said die and said punch are separated from one another, and a billet can be placed adjacent the cavity of said die to be formed, when the two are returned to the first position, to the shape of the single cavity, an ejector pin which is movable relative to said die between a first position where a given surface thereof adjoins a portion of the cavity of said die and a second position where the given surface extends into the cavity of said die, and means associated with the given surface of said ejector pin operable to form an embossed or depressed indicium on a part that is precision formed in the apparatus when the given surface adjoins a portion of the cavity of said die.

11. Apparatus for precision forming a heated billet, said apparatus comprising a die which has a cavity bounded by sidewalls extending therethrough opposed ones of the sidewalls of said die having forming surfaces, a punch which is slidably receivable in the cavity of said die, an anvil which is slidably receivable in the cavity of said die, said punch and said die having forming surfaces which face one another when the two are slidably received in the cavity of said die, and means for causing relative movement of said die, and at least one of said punch and said anvil between (a) a first position in which said punch and said anvil are slidably received within the cavity of said die, the forming surfaces of said punch and of said anvil face one another and the forming surfaces of said die, of said punch, and of said anvil form a single, closed forming cavity which has a central region, a first longitudinally extending portion which extends outwardly in a given direction from the central region, and a second longitudinally extending portion which extends outwardly in a different direction from the central region, the opposed forming surfaces of said die adjoining opposed surfaces of the central region, of the first longitudinally extending portion and of the second longitudinally extending portion of the forming cavity, the forming surfaces of said punch and of said anvil adjoining end walls of the first and second longitudinally extending portions and opposed surfaces of the central region of the first longitudinally extending portion and of the second longitudinally extending portion which extend between the opposed surfaces adjoined by the forming surfaces of said die, so that forming surfaces of said punch of said anvil and of said die enclose the entire forming cavity, and (b) a second position in which said die and at least one of said punch and said anvil are separated from one another, and a billet can be placed in the cavity of said die to be formed, when the three are returned to the first position, to the shape of the single forming cavity.

12. Apparatus for precision forming, said apparatus comprising a die with a cavity which conforms with the shape of a portion of a part to be formed, which shape includes a central body and opposed legs at opposite ends of, and extending in a given direction from, the central body, a punch with a cavity which conforms with the shape of another portion of the part to be formed, means for causing relative movement of said die and said punch in the given direction between (a) a first position in which said punch and said die abut or nearly abut one another, and the cavity of said die and the cavity of said punch are aligned and form a single cavity which conforms, at the temperature of formation, with all of the shape of the part to be formed except the ends of the legs and (b) a second position in which said die and said punch are separated from one another, and a billet can be positioned to be precision formed by said punch and said die when the two are returned to the first position, to the shape of the single cavity, plates on opposite sides of the cavity of said punch, mounted for sliding movement relative to said punch in a direction parallel to the direction of relative movement between said die and said punch, and means urging said plates toward said die, said plates being so positioned that, during relative movement between said die and said punch, end surfaces thereof contact and shape the ends of the legs of the part being precision formed.

13. Apparatus for precision forming, said apparatus comprising a die which has a cavity, a first part of which conforms with the shape of a portion of a part to be formed, and a second part of which diverges away from such first part, a punch with a cavity which conforms with the shape of another portion of the part to be formed, and means for causing relative movement of said die and said punch between (a) a first position in which said punch extends through the second part of the cavity of said die, said die and said punch abut or nearly abut one another, and the first part of the cavity of said die and the cavity of said punch intersect or nearly intersect and are aligned and form a single cavity which conforms, at the temperature of formation, with the shape of the part to be formed, and (b) a second position in which said die and said punch are separated from one another, the second cavity of said die is between the first cavity of said die and the cavity of said punch, and a billet can be placed in the second cavity of said die to be die formed, when the two are returned to the first position, to the shape of the single cavity, the second part of the die cavity being between opposed die walls which extend away from the first part of the die cavity from its intersection or near intersection with the punch cavity when said punch and said die are in the first position, and are planar and parallel at such intersection, and then curve away from one another as they extend away from said first part of said die cavity.

14. Apparatus as claimed in claim 13 wherein the walls of said punch adjacent the punch cavity which conforms with the shape of a portion of the part to be formed are of such a size and configuration that, when said punch and said die are in the first position, they extend between the portions of the laterally extending walls of said die which are parallel to one another.

15. In apparatus for precision forming, which apparatus comprises a die with a cavity which conforms with the shape of a portion of a part to be formed, a punch with a cavity which conforms with the shape of another portion of the part to be formed, and means for causing relative movement of the die and the punch between (a) a first position in which the die and the punch abut or nearly abut one another and the two cavities are aligned and form a single cavity which conforms, at the temperature of formation, with the shape of the part to be formed, and (b) a second position in which the die and the punch are separated from one another and a billet can be placed in the cavity of one to be die formed, when the two are returned to the first position, to the shape of the single cavity, the improvement which comprises a pair of spaced billet supports each of which has an upward-facing surface and is mounted for sliding movement relative to one of the die and the punch between an upper position in which it extends above an upwardly facing surface of the die or the punch which surface is adjacent a part of the cavity therein which conforms with the shape of a portion of a part to be formed and a lower position in which the upward-facing surface of each of said billet supports is a part of the upwardly facing surface of the die or the punch, as the case may be, the locations of said billet supports being such that a billet thereon, when said supports are in their upper position, is located to be precision formed when the punch and the die are moved to their first position, and means resiliently urging said billet supports toward their upper positions, whereby, when the punch and the die are in their second position, said billet supports are urged by said resilient means into their upper positions, and, as the punch and the die are moved to the first position, a billet placed on the upward-facing surfaces of said billet supports while the punch and the die are in the second position, is precision formed and said billet supports are moved to their lower positions.

16. Apparatus as claimed in claim 15 wherein said supports, when in their upper positions, locate a billet positioned thereon above the lower of said die and said punch, and below the other, whereby an optical sensor can be used, when the die and the punch are in their second position, to determine whether or not there is a billet on said supports.

17. Apparatus for precision forming, said apparatus comprising a die which has a cavity that is between opposed, laterally extending walls, and has a first part which conforms with the shape of a portion of a part to be formed, and a second part which diverges away from such first part, the portions of said walls which are adjacent such second cavity part extending parallel to one another away from the adjoining portions of said walls which are adjacent such first cavity part, and then curving away from one another, a punch with a cavity which conforms with the shape of another portion of the part to be formed, means for causing relative movement of said die and said punch between (a) a first position in which said punch extends through the second part of the cavity of said die and between the portions of said die walls that are parallel to one another, said die and said punch abut or nearly abut one another, and the first part of the cavity of said die and the cavity of said punch are aligned and form a single cavity which conforms, at the temperature of formation, with the shape of the part to be formed, and (b) a second position in which said die and said punch are separated from one another, the second cavity of said die is between the first cavity of said die and the cavity of said punch, and a billet can be placed in the second cavity of said die to be die formed, when the two are returned to the first position, to the shape of the single cavity, plates on opposite sides of the cavity of said punch, mounted for sliding movement relative to said punch in a direction parallel to the direction of relative movement between said die and said punch, and means urging said plates toward said die, said plates being so positioned that, during relative movement between said die and said punch, surfaces thereof bear upon the ones of said walls which form the second cavity of said die, and confine metal that would otherwise be scarfed from a billet.

18. Apparatus as claimed in claim 17 which additionally includes means operable to support a billet placed in the cavity of the die or of the punch, when the two are in the second open position, above the bottom of the cavity and said support means being operable to be withdrawn from the cavity before its presence therein would interfere with precision forming of the billet.

19. Apparatus for precision forming, said apparatus comprising a die which has a cavity, a first part of which is between first opposed die walls, and conforms with the shape of a portion of a part to be formed, and a second part of which is between second opposed die walls which diverge away from said first opposed die walls, a punch with a cavity which conforms with the shape of another portion of the part to be formed, means for causing relative movement of said die and said punch between (a) a first position in which said punch extends between said second opposed die walls, said die and said punch abut or nearly abut one another, and the first part of the cavity of said die and the cavity of said punch are aligned and form a single cavity which conforms, at the temperature of formation, with the shape of the part to be formed, and (b) a second position in which said die and said punch are separated from one another, the second cavity of said die is between the first cavity of said die and the cavity of said punch, and a billet can be placed in the second cavity of said die to be die formed, when the two are returned to the first position, to the shape of the single cavity, inner and outer plates on each side of the cavity of said punch, mounted adjacent and parallel to one another for sliding movement relative to said punch in a direction parallel to the direction of relative movement between said die and said punch, said inner plates being closely adjacent said punch and between said outer plates and said punch, and said outer plates being closely adjacent said inner plates, and means urging said plates toward said die, said plates being so positioned that, during relative movement between said die and said punch, surfaces of the outer ones of said plates bear upon the walls which form the second part of the cavity of said die, and confine metal that would otherwise be scarfed from a billet, and, with further relative movement, surfaces of inner ones of said plates bear upon the walls which form the second cavity of said die, and confine metal that would otherwise be scarfed from a billet.

20. Apparatus as claimed in claim 19 which additionally includes means operable to support a billet placed in the cavity of the die or of the punch, when the two are in the second open position, above the bottom of the cavity and said support means being operable to be withdrawn from the cavity before its presence therein would interfere with precision forming of the billet.

21. In apparatus for precision forming, which apparatus comprises a punch with a cavity bounded by walls, a plurality of interchangeable dies each with a cavity bounded by walls, for selected use with the punch, and means for causing relative movement of the punch and any selected one of the dies in a given direction between (a) a first position in which the punch and the selected one of the dies abut or nearly abut one another and the two cavities are aligned and the walls which bound the punch cavity and the cavity of the selected one of the dies form a single cavity, and (b) a second position in which the punch and the selected one of the dies are separated from one another and a billet can be placed in the cavity of one to be die formed, when the two are returned to the first position, to the shape of the single cavity, the improvement wherein the punch forms with each of the interchangeable dies, when the die is selected and the punch and the selected die are in the first position relative to one another, a single cavity which has a central region, a first longitudinally extending portion which extends outwardly in a given direction from the central region and has an end surface, and a second longitudinally extending portion which extends outwardly in a different direction from the central region and has an end surface, the two end surfaces being either parallel to the given direction of relative movement between the punch and the selected one of the dies or extending at an angle other than 90° to that given direction of relative movement, the walls which bound the punch cavity forming no portion of the end surfaces of the single cavity, while the walls which bound the cavity of the selected one of each of the interchangeable dies form the end surfaces in their entirety, and wherein the single cavities formed by the punch and each of the interchangeable dies, when in the first position relative to one another differ from one another with respect to one or more of the distance between the two end surfaces, the length of one of the longitudinally extending portions, and the length of both longitudinally extending portions, but being otherwise identical.

22. In apparatus as claimed in claim 21 the additional improvement which includes means operable to support a billet placed in the cavity of the die or of the punch, when the two are in the second open position, above the bottom of the cavity and said support means being operable to be withdrawn from the cavity before its presence therein would interfere with precision forming of the billet.

23. Apparatus as claimed in claim 21 wherein the walls of the die which bound the two end surfaces of the single cavity are either parallel to the given direction of relative movement between the punch and the die or extend at an angle not greater than about 45° to that given direction of relative movement.

* * * * *

UNITED STATES PATENT AND TRADEMARK OFFICE

CERTIFICATE OF CORRECTION

PATENT NO. : 5,493,888

DATED : Feb. 27, 1996

INVENTOR(S) : Merkle et al.

It is certified that error appears in the above-identified patent and that said Letters Patent is hereby corrected as shown below:

Column 9, Line 29 should read:
the shape of the blank 46. It will be appreciated that, as in Column 9, Line 32 should read:
punch (49 in FIGS. 8 and 9) forms a part of the blank 46, Column 9, Line 36 should read:
46, but no portion of the longitudinally opposed end walls Column 14, line 50 should read:
15, 16, 17, 18, 19, 22, 23, 24, 25, 26, 27, 28 and 29 are all Column 15, Line 11 should read:
173 in FIG. 40. The fitting 173 has a tube thread 174 and Signed and Sealed this Tenth Day of September, 1996

*Attest:*

Bruce Lehman

BRUCE LEHMAN

*Attesting Officer*

*Commissioner of Patents and Trademarks*